US011518639B2

(12) United States Patent
Xie

(10) Patent No.: US 11,518,639 B2
(45) Date of Patent: Dec. 6, 2022

(54) PAPER EJECTION APPARATUS, PAPER EJECTION METHOD, AND IMAGE FORMING SYSTEM

(71) Applicant: Ji Xie, Kanagawa (JP)

(72) Inventor: Ji Xie, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/453,024

(22) Filed: Nov. 1, 2021

(65) Prior Publication Data

US 2022/0135360 A1 May 5, 2022

(30) Foreign Application Priority Data

Nov. 4, 2020 (JP) ..... JP2020-184497

(51) Int. Cl.

| | |
|---|---|
| ***B65H 29/62*** | (2006.01) |
| ***B65H 31/24*** | (2006.01) |
| ***B65H 43/04*** | (2006.01) |
| ***G03G 15/00*** | (2006.01) |

(52) U.S. Cl.

CPC ..... *B65H 29/62* (2013.01); *B65H 31/24* (2013.01); *B65H 43/04* (2013.01); *G03G 15/6552* (2013.01); *B65H 2511/413* (2013.01); *B65H 2511/52* (2013.01); *B65H 2801/06* (2013.01)

(58) Field of Classification Search

None

See application file for complete search history.

(56) References Cited

U.S. PATENT DOCUMENTS

| | | | | |
|---|---|---|---|---|
| 6,804,473 | B2 | 10/2004 | Nakamura et al. | |
| 9,088,745 | B2 | 7/2015 | Kitai et al. | |
| 9,284,154 | B2 * | 3/2016 | Seidler | B65H 43/04 |
| 9,317,914 | B2 | 4/2016 | Kitai | |
| 9,342,898 | B2 | 5/2016 | Kitai | |
| 9,390,493 | B2 | 7/2016 | Kitai et al. | |
| 9,823,884 | B2 | 11/2017 | Kitai | |
| 9,898,814 | B2 | 2/2018 | Kitai et al. | |

(Continued)

FOREIGN PATENT DOCUMENTS

| | | |
|---|---|---|
| JP | 4261826 | 4/2009 |
| JP | 2012-231312 | 11/2012 |

(Continued)

OTHER PUBLICATIONS

Extended European Search Report for 21205826.7 dated Mar. 17, 2022.

*Primary Examiner* — Leslie A Nicholson, III
(74) *Attorney, Agent, or Firm* — IPUSA, PLLC

(57) ABSTRACT

A paper ejection apparatus including: paper ejection trays to which printed sheets are selectively ejected; a main tray disposed lower than the paper ejection trays; an inspection result acquirer configured to acquire an inspection result of each of the printed sheets; a paper ejection controller configured to control paper ejection such that each of the printed sheets is ejected to the paper ejection trays before the inspection result is obtained by the inspection result acquirer; and a tray information manager configured to manage by associating identification information of each of the paper ejection trays with the inspection result of each of the printed sheets ejected on the paper ejection trays.

12 Claims, 25 Drawing Sheets

(56) References Cited

U.S. PATENT DOCUMENTS

| | | | | |
|---|---|---|---|---|
| 10,315,879 | B2 * | 6/2019 | Harano | B65H 31/24 |
| 2015/0153698 | A1 * | 6/2015 | Monde | G03G 15/6552 399/361 |
| 2018/0005491 | A1 * | 1/2018 | Van Asdale | G07F 17/3267 |
| 2019/0238685 | A1 | 8/2019 | Tsukamoto | |
| 2021/0382669 | A1 * | 12/2021 | Kimura | G06F 3/121 |

FOREIGN PATENT DOCUMENTS

| | | | |
|---|---|---|---|
| JP | 2013-111871 | | 6/2013 |
| JP | 2014153560 | A * | 8/2014 |
| JP | 2015-049189 | | 3/2015 |
| JP | S717286 | | 7/2020 |

* cited by examiner

FIG.11A

| STATUS OF TRAY 21-1 | OPERATION TO MAIN TRAY |
|---|---|
| PAPER EJECTION | NONE |
| RE-PRINT | NONE |
| INSPECTION | NONE |
| OK | NORMAL MOVING,<br>TRAY 21-1 [STANDBY] |
| NG | SHIFTED MOVING,<br>TRAY 21-1 [RE-PRINT] |
| NR | SHIFTED MOVING,<br>TRAY 21-1 [STANDBY] |
| STANDBY | NONE |

FIG.11B

| [S] / [S-1] | PAPER EJECTION | RE-PRINT | INSPECTION | OK | NG | NR | PAPER EJECTION |
|---|---|---|---|---|---|---|---|
| PAPER EJECTION | NONE | NONE | NONE | NONE | NONE | NONE | NONE |
| RE-PRINT | NONE | NONE | NONE | NONE | NONE | NONE | NONE |
| INSPECTION | NONE | NONE | NONE | NONE | NONE | NONE | NONE |
| OK | NONE | NONE | NONE | MOVEMENT S STANDBY S-1 OK | NONE | NONE | NONE |
| NG | NONE | NONE | NONE | NONE | MOVEMENT S RE-PRINT S-1 NG | MOVEMENT S STANDBY S-1 NG | NONE |
| NR | NONE | NONE | NONE | NONE | MOVEMENT S RE-PRINT S-1 NR | MOVEMENT S STANDBY S-1 NR | NONE |
| STANDBY | MOVEMENT S STANDBY S-1 PAPER EJECTION | MOVEMENT S STANDBY S-1 RE-PRINT | MOVEMENT S STANDBY S-1 INSPECTION | MOVEMENT S STANDBY S-1 OK | MOVEMENT S RE-PRINT S-1 NR | MOVEMENT S STANDBY S-1 NR | NONE |

PAPER EJECTION APPARATUS, PAPER EJECTION METHOD, AND IMAGE FORMING SYSTEM

CROSS-REFERENCE TO RELATED APPLICATIONS

The present application claims priority under 35 U.S.C. § 119 to Japanese Patent Application No. 2020-184497, filed Nov. 4, 2020, the contents of which are incorporated herein by reference in their entirety.

BACKGROUND OF THE INVENTION

Field of the Invention

The disclosures herein generally relate to a paper ejection apparatus, a paper ejection method, and an image forming system.

Description of the Related Art

For example, in production printing (commercial printing), there is a requirement to inspect a printout of a printer to determine whether it is non-defective or defective based on the presence or non-presence of an abnormal condition or a defect. In response to the requirement, a technique to inspect whether a printed sheet is normal is known in which an inspection device compares document image data, which is image data of a printing source, with read image data, which is image data produced by reading the printed sheet of the document image data by the scanner. This technique requires that if the printed sheet is abnormal, the printed sheet with the abnormal inspection result is removed and replaced with the printed sheet with the normal inspection result without requiring user intervention.

A printer has been proposed that temporarily stores a printed sheet with a normal inspection result in a conveying path so that the printed sheet with the abnormal inspection result is automatically removed (see, for example, Japanese Patent No. 4261826). In this printer, when an abnormality of a printed sheet is detected during the paper ejection of another printed sheet for which no abnormality is detected to the paper ejection unit, the printed sheet for which the abnormality is detected is stored in the abnormal sheet housing unit. The printer then temporarily stores the subsequent printed sheet for which no abnormality is detected in the normal sheet housing unit. The printer prints an image which was printed on the printed sheet with the abnormal inspection result on another printed sheet in place of the printed sheet with the abnormal inspection result. Such another printed sheet is ejected to the paper ejection unit, then the printed sheet which was stored in the normal sheet housing unit is ejected to the paper ejection unit. As a result, the removal of the printed sheet with the abnormal inspection result and the recovery of the removed printed sheet can be automatically performed.

However, there is a problem in the background art in that the paper ejection apparatus cannot eject a printed sheet until the inspection result is obtained. In high-speed printers, a printed sheet is often already ejected when the inspection result is confirmed. Therefore, when employing a configuration that does not eject a printed sheet until the inspection result is confirmed, a mechanism such as a longer conveying path, and a primary storage for the printed sheet with the abnormal inspection result, is necessary. The paper ejection apparatus of the background art that ejects paper after obtaining the inspection result may lead to increased costs and larger size of the printer which are inconvenient.

In view of the above-described problem, the present invention is intended to provide a paper ejection apparatus capable of ejecting a printed sheet before obtaining an inspection result.

SUMMARY OF THE INVENTION

According to an embodiment, a paper ejection device includes: paper ejection trays to which printed sheets are selectively ejected; a main tray disposed lower than the paper ejection trays; an inspection result acquirer configured to acquire an inspection result of each of the printed sheets; a paper ejection controller configured to control paper ejection such that each of the printed sheets is ejected to the paper ejection trays before the inspection result is obtained by the inspection result acquirer; and a tray information manager configured to manage by associating identification information of each of the paper ejection trays with the inspection result of each of the printed sheets ejected on the paper ejection trays, wherein the tray information manager secures, for reprinting, one of the paper ejection trays on which a printed sheet with an abnormal inspection result is ejected, and wherein the paper ejection controller controls paper ejection such that a reprinted sheet having a page number that is same as that of the printed sheet with the abnormal inspection result is ejected to the one of the paper ejection trays that is secured.

BRIEF DESCRIPTION OF THE DRAWINGS

FIG. 11A is a table which explains the sorting operation from the paper ejection tray 21-1 to the main tray;

FIG. 11B is a table which explains the sorting operation of the paper ejection trays 21-2 to 21-4;

DESCRIPTION OF THE EMBODIMENTS

In the following, as an example of an embodiment of the present invention, a paper ejection apparatus and a paper ejection method performed by the paper ejection apparatus will be described with reference to the drawings.

Figure 1:
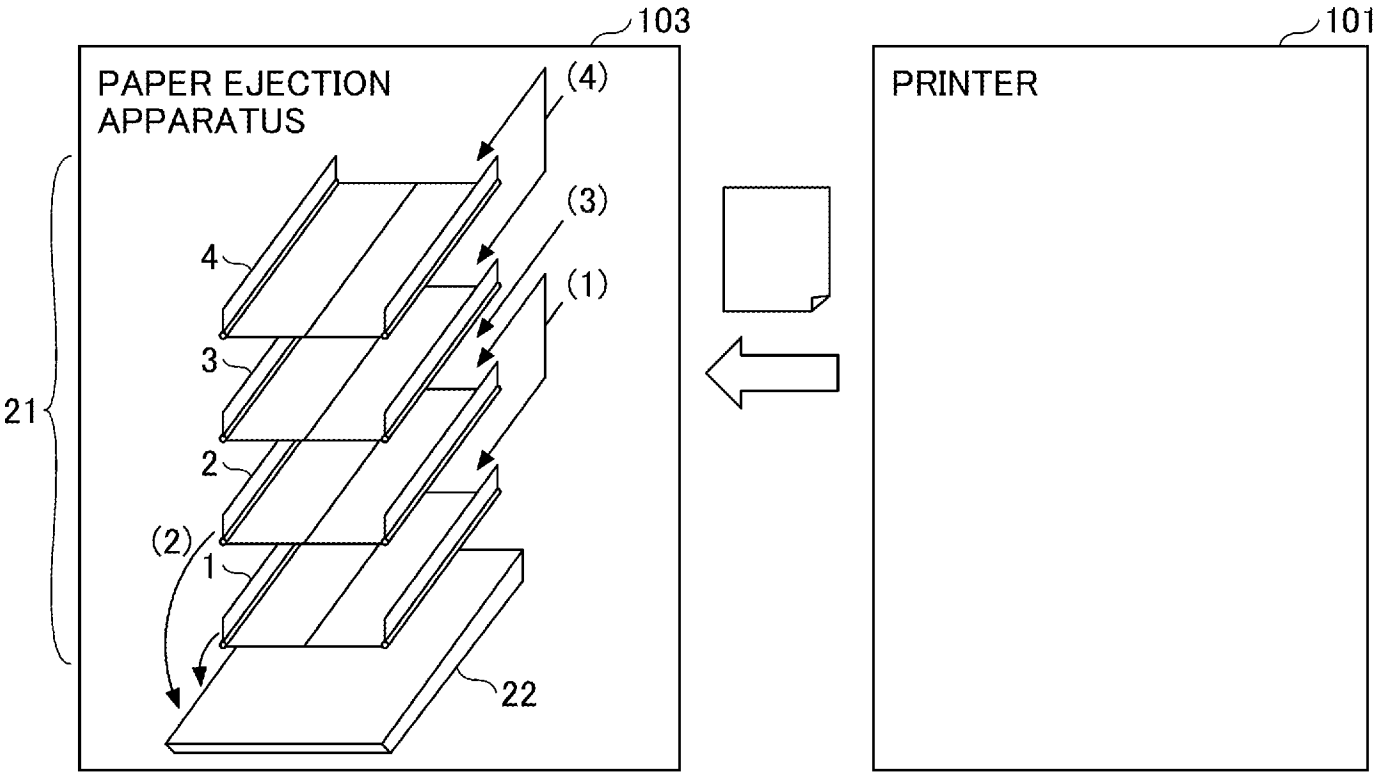
FIG. 1 is a diagram illustrating an outline of a paper ejection method by a paper ejection apparatus.

FIG. 1 is a diagram illustrating an outline of the paper ejection method by a paper ejection apparatus 103. The paper ejection apparatus 103 has a plurality of trays.

(1) The paper ejection apparatus 103 ejects a predetermined number of printed sheets at a time, to paper ejection trays 21 sequentially from the bottom to the top before the inspection result is confirmed.

(2) Once the inspection result is obtained (once the inspection result is confirmed), the paper ejection apparatus 103 moves the printed sheet with normal inspection result to the main tray 22 without any change. If the printed sheet with abnormal inspection result is present on any one of the paper ejection trays 21, the paper ejection control is performed in which the paper ejection apparatus 103 moves the printed sheet with the abnormal inspection result to the main tray 22 in a state in which a user can distinguish the printed sheet with the abnormal inspection result from the printed sheet with the normal inspection result. The state in which the user can distinguish the printed sheet with the abnormal inspection result from the printed sheet with the normal inspection result is, for example, a relatively shifted state in which the abnormal printed sheet is offset with respect to the normal printed sheets on the main tray 22. For the sake of explanation, it is assumed that the paper ejection tray 21-2 of the paper ejection trays 21 contains the printed sheet with the abnormal inspection result.

(3) When the paper ejection apparatus 103 moves the printed sheet with the abnormal inspection result to the main tray 22, a reprinted printed sheet is ejected on the paper ejection tray 21-2 on which the printed sheet with the abnormal inspection result was ejected. That is, it is the paper ejection tray 21-2 that receives the reprinted printed sheet.

(4) Until the reprinted printed sheet is ejected on the paper ejection tray 21-2, the paper ejection apparatus 103 ejects printed sheets with the normal inspection result in the conveying path on the trays above the paper ejection tray 21-2 where the reprinted printed sheet is to be ejected.

As described above, the paper ejection apparatus 103 ejects the printed sheet with the abnormal inspection result on the main tray 22 in the state in which the printed sheet with the abnormal inspection result is shifted from the printed sheets with the normal inspection result, and one of the paper ejection trays is secured for reprinting. Therefore, the printed sheets are ejected on the main tray 22 in the order of pages. The user can obtain the printed sheets with the normal inspection result, which are ultimately sorted correctly, by simply pulling out the printed sheet with the abnormal inspection result. Since the paper ejection apparatus 103 can eject sheets of paper into the paper ejection tray above the paper ejection tray for reprinting without waiting for the inspection result, a mechanism such as a longer conveying path or a primary storage for the printed sheet with the abnormal inspection result, is unnecessary.

<Terminology>

The term "sorting" means moving the printed sheet from the higher paper ejection tray to the lower paper ejection tray, or from the lowermost paper ejection tray to the main tray, depending on the inspection result of the printed sheet. The term "shifted moving" means moving the printed sheet in a shifted state.

The expression "the inspection result of the printed sheet" means normal and abnormal determination results based on a difference from the original print data. If the difference is greater than or equal to the threshold, image quality of the printed sheet is determined to be abnormal. If the difference is less than the threshold, image quality of the printed sheet is determined to be normal. The threshold is set based on whether the difference is such that reprinting is needed.

The expression "before obtaining the inspection result from the inspection device" means that the printed sheet is under inspection or before being inspected. In other words, the inspection result does not have to be confirmed at the time the printed sheet is ejected.

Regarding the expression "a state in which the printed sheet with the abnormal inspection result can be distinguished from the printed sheet with the normal inspection result", it suffices if the user can identify the printed sheet with the abnormal inspection result. Examples of the state include shifted, colored, folded, wrinkled, discarded, and the like.

The expression "the paper ejection tray is secured for reprinting" means that, to the paper ejection tray on which the printed sheet with the abnormal inspection result is ejected, the printed sheet of the same page as the printed sheet with the abnormal inspection result is ejected. Note that, when another lower paper ejection tray is in a standby status, the printed sheet of the same page as the printed sheet with the abnormal inspection result may be ejected into the another paper ejection tray.

<Configuration Example>

Figure 2:
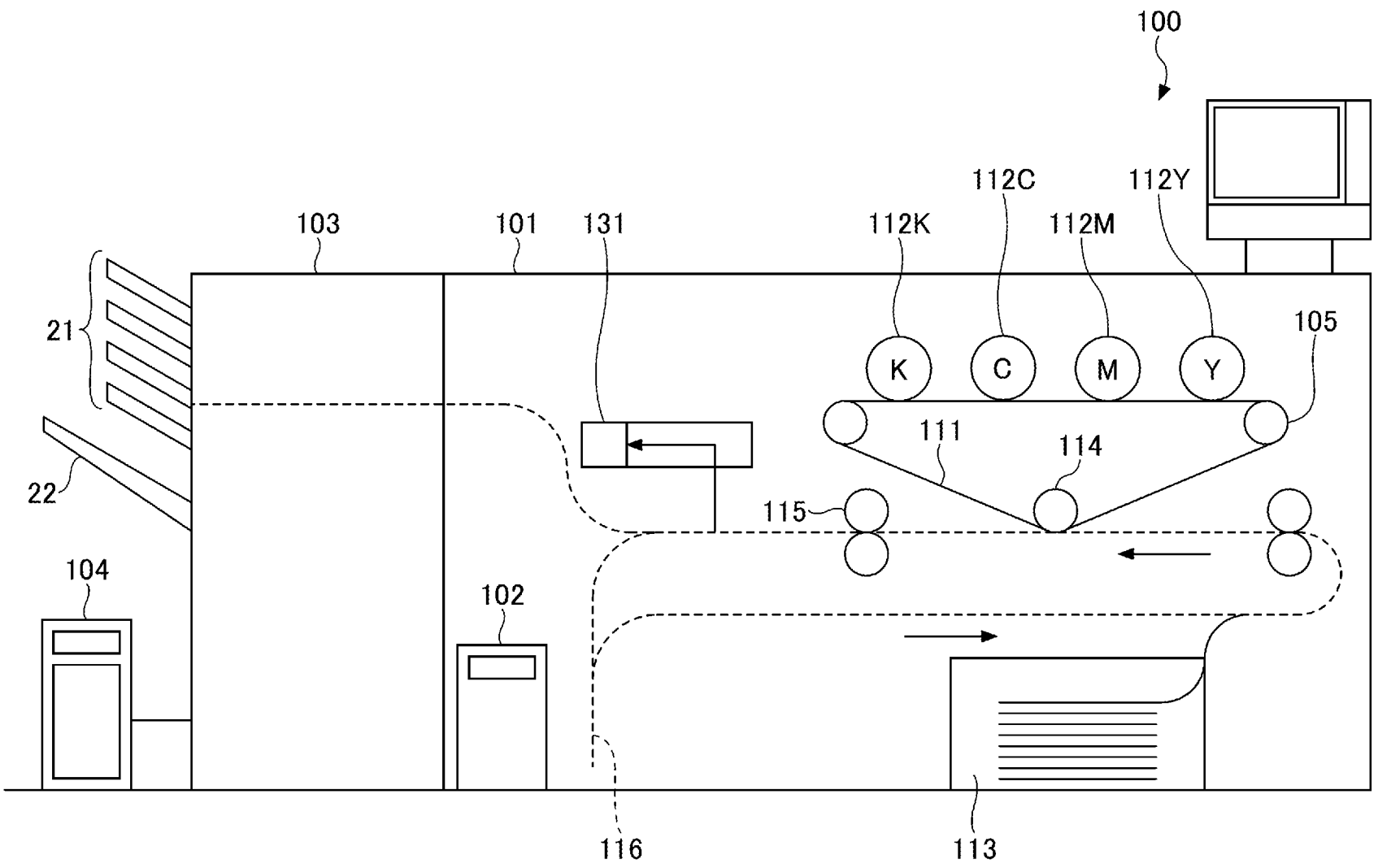
FIG. 2 is a diagram illustrating a configuration example of an image forming system according to the present embodiment.

FIG. 2 is a diagram illustrating a configuration example of an image forming system 100 according to the present embodiment. As shown in FIG. 2, the image forming system 100 includes a DFE (Digital Front End) 104, a printer 101, an inspection device 102, and a paper ejection apparatus 103. The printer 101 is connected to each of the DFE 104, the inspection device 102, and the paper ejection apparatus 103, by a dedicated interface.

The DFE 104 is an image processing device that generates the print data to be printed based on a received print job. A specific example of the print data is bitmap data which is an image to be output. The DFE 104 also transmits the generated bitmap data to the printer 101.

The printer 101 controls a print engine 105 based on the bitmap data received from the DFE 104 to perform the image forming output. The printer 101 transmits the bitmap data received from the DFE 104 to the inspection device 102 as information that serves as a basis for a master image for reference when the inspection device 102 inspects an output product of the image formation by the print engine 105. The printer 101 may print information identifying a page (page number described later) on each page of the printed sheet. The printer 101 may automatically print information identifying the page in a margin in a case where the margin (a portion to be cut) is set to be provided on the page.

The printer 101 is an image forming apparatus that executes image forming output on printing paper that is a recording medium based on the bitmap data. The recording medium may be one to which toner or ink can attach, e.g., one to which toner or ink can attach temporarily, one to which toner or ink can attach and adhere, one to which and into which toner or ink can attach and permeate, and the like. Examples include recording media such as paper, recording paper, paper for recording, film, cloth, and the like, electronic components such as an electronic board and a piezoelectric element, media such as a powder bed, and the like, and include all media to which toner or ink can attach, unless otherwise specified.

The material of "the recording medium to which toner or ink can attach" may be any materials to which toner or ink can temporarily attach, such as paper, yarn, fiber, fabric, leather, metal, plastic, glass, wood, ceramics, and the like.

The print engine 105 has what is known as a tandem type configuration in which photoconductor drums 112Y, 112M, 112C, and 112K (hereinafter, generally referred to as a photoconductor drum 112) of each color are arranged along a conveying belt 111 which is an endless conveying means. The conveying belt 111 is an intermediate transfer belt on which an intermediate transfer image to be transferred to paper (an example of a recording medium) fed from a paper feeding tray 113, is formed. Along the conveying belt 111, the photoconductor drums 112Y, 112M, 112C, and 112K are sequentially arranged from the upstream side of the conveying belt 111 in the conveying direction.

Toner images of K (black), C (cyan), M (magenta), and Y (yellow) developed with toner on the surface of the photoconductor drum 112 of each color are superimposed on the conveying belt 111 and transferred to form a full color image. The full color image thus formed on the conveying belt 111 is transferred onto the paper that has been conveyed on the path by the function of a transfer roller 114 at the position closest to the conveying path of the paper illustrated with the broken line in FIG. 2.

In the present embodiment, the print engine 105 of the printer 101 has been described on the assumption that it is an electrophotographic type, but the present invention is not limited to this, and the printer 101 of another type such as an ink jet type may be used.

The paper on which the image is formed is further conveyed, and the image is fixed by a fixing roller 115. Then, the paper is conveyed to the inspection device 102.

The printer 101 includes a reading device 131. The reading device 131 reads the surface of each of the sheets of paper conveyed through the fixing roller 115 and generates a read image.

The inspection device 102 acquires the read image read by the reading device 131. The inspection device 102 generates the master image, which is an example of reference data, based on the bitmap data directly input from the DFE 104 or input from the DFE 104 via the printer 101. Then, the inspection device 102 performs inspection of an output result (inspection of the image printed on the paper that is the recording medium) by comparing the read image which is generated by the reading device 131 by reading the paper which is output by the printer 101, with the master image generated.

The inspection device 102 notifies the printer 101 of defect inspection information, which is inspection result information, including the defect page determined to be defective (abnormal) when it is determined that there is a defect (an abnormality) in the image on the paper of the output result by the inspection. Thus, the printer 101 performs reprint control of the defective page. The printer 101 may perform control for stopping printing without performing reprint control of the defective page. The inspection device 102 transmits the defect inspection information that is the inspection result information to a server 202, and the server 202 stores the information. The inspection device 102 may include a server therein, store the information into the server, and form a Web server.

The paper inspected by the inspection device 102 is directly transmitted to the paper ejection apparatus 103 in the case of single-side printing.

In the case of double-side printing, the paper inspected by the inspection device 102 is conveyed to a reverse path 116, is reversed, and is conveyed to the transfer position of the transfer roller 114 again. The toner image is transferred and fixed to the paper conveyed again to the transfer position of the transfer roller 114, on the side opposite from the side of the paper to which single-side printing was performed. Thereafter, the duplex-printed paper inspected by the inspection device 102 is transmitted to the paper ejection apparatus 103.

The paper ejection apparatus 103 stacks the sheets ejected from the printer 101 on the paper ejection trays 21. Details of the paper ejection will be described later.

Figure 3:
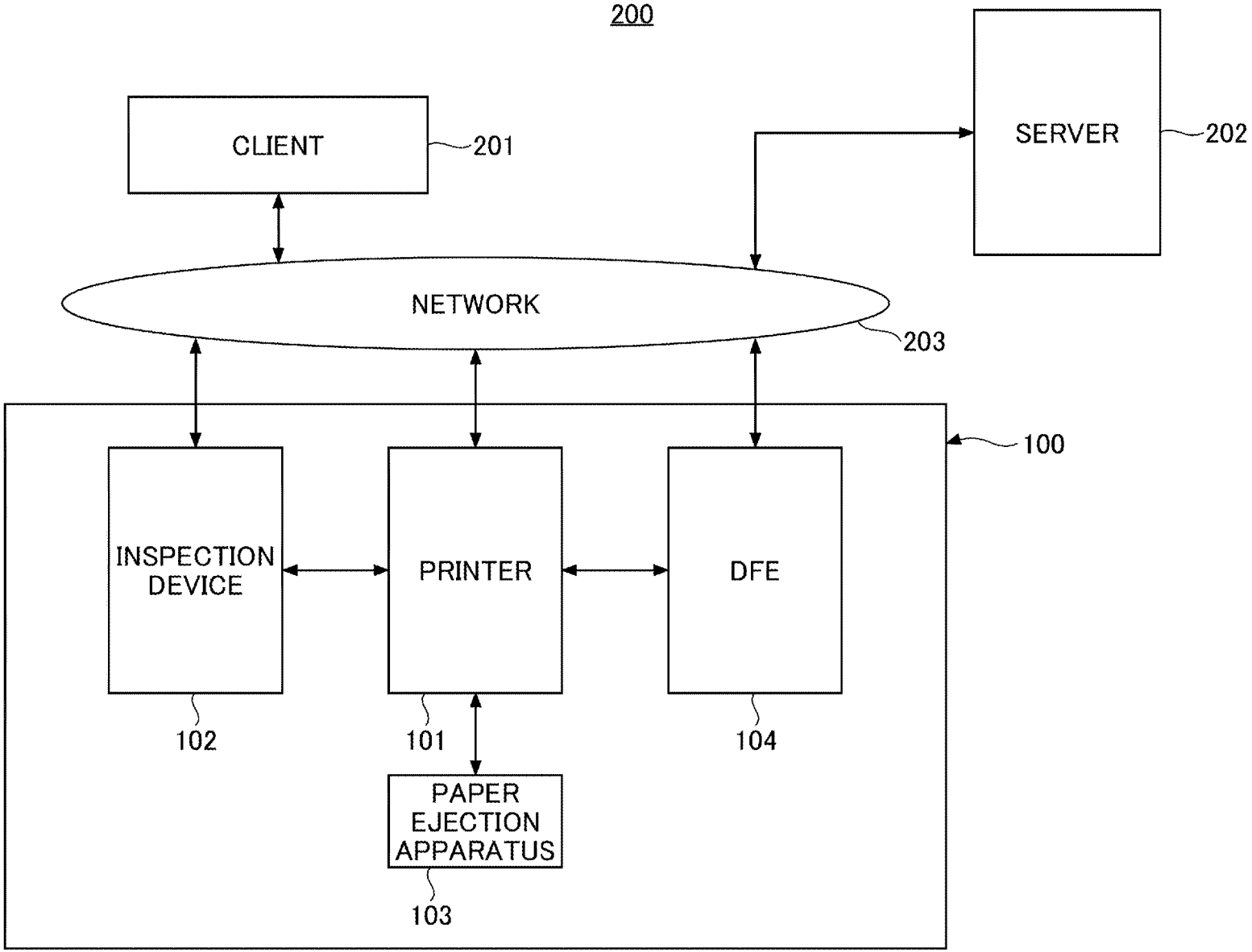
FIG. 3 is a block diagram schematically illustrating a configuration of an information processing system.

FIG. 3 is a block diagram schematically illustrating a configuration of an information processing system 200. As shown in FIG. 3, the information processing system 200 including the image forming system 100 includes a client 201 and a server 202 in addition to the image forming system 100.

Each of the parts of the image forming system 100 (the DFE 104, the printer 101, the inspection device 102, and the paper ejection apparatus 103), the client 201, and the server 202 are connected to a network 203. The network 203 may be, for example, a local area network (LAN), the Internet, and the like.

The client 201 is an information processing device having a communication function and a content output function. The client 201 may be a variety of terminal devices, such as a PC (Personal Computer), a tablet terminal, and the like. The client 201 transmits a print job to the DFE 104 via the network 203. The client 201 also displays the inspection result of the inspection device 102. The client 201 includes a Web browser. The client 201 accesses the server 202 described later via the network 203. The client 201 acquires the inspection result information (defect inspection information) stored in the server 202 and displays it as a display screen information (for example, an HTML file), and accepts the user's operation to the display screen on the Web browser. The DFE 104 can receive the print job from the client 201. The DFE 104 can also receive the print job from the printer 101 and the inspection device 102, through the network 203.

The server 202 receives the defect inspection information sent from the inspection device 102 via the network 203. The server 202 generates a DB (database 33) based on the received defect inspection information. The server 202 stores the generated DB. The server 202 transmits/receives data to/from the client 201 via the network 203. The server 202 may be provided inside the inspection device 102.

<Example of Hardware Configuration>

Figure 4:
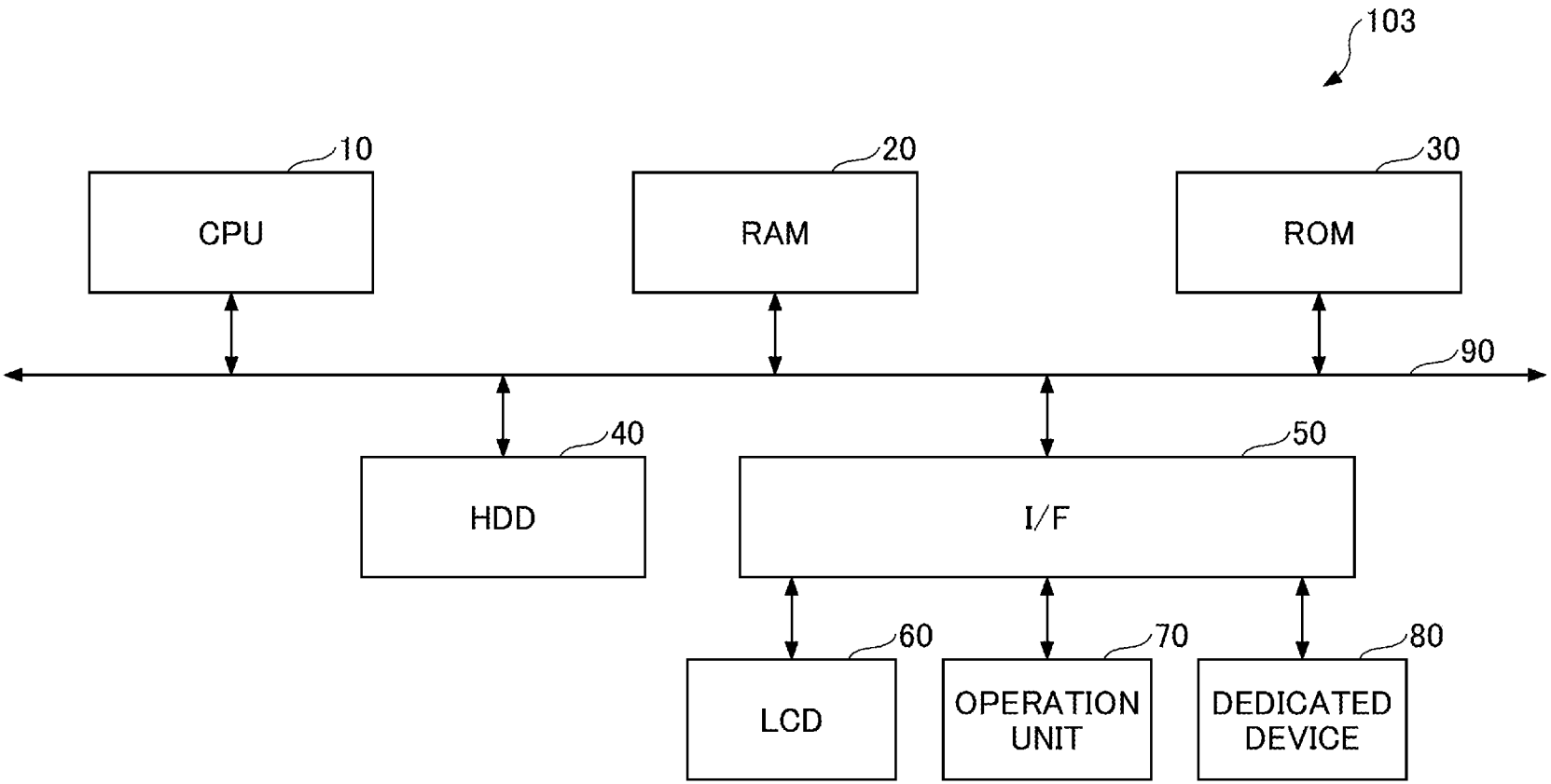
FIG. 4 is a block diagram illustrating an example of a hardware configuration of a controller of the paper ejection apparatus.

FIG. 4 is a block diagram illustrating a hardware configuration of a controller of the paper ejection apparatus 103. In FIG. 4, the hardware configuration of the controller of the paper ejection apparatus 103 is illustrated, but the same applies to the controller of the printer 101, the controller of the DFE 104, the controller of the inspection device 102, or the controller of the server 202.

As shown in FIG. 4, the controller of the paper ejection apparatus 103 according to the present embodiment has the same kind of configuration as a general PC (Personal Computer) or a server. That is, the controller of the paper ejection apparatus 103 according to the present embodiment is connected to a CPU (central processing unit) 10, a RAM (Random Access Memory) 20, a ROM (Read Only Memory) 30, an HDD (hard disk drive) 40, and an I/F 50 via a bus 90. An LCD (Liquid Crystal Display) 60, an operation unit 70, and a dedicated device 80 are connected to the I/F 50.

The CPU 10 is a computing means and controls the entire operation of the paper ejection apparatus 103. The RAM 20 is a volatile storage medium capable of high-speed reading and writing of information and is used as a working area when the CPU 10 processes information. The ROM 30 is a non-volatile storage medium dedicated to reading, and a program such as firmware is stored therein. The HDD 40 is a non-volatile storage medium capable of reading and writing information, and contains an OS (Operating System), various control programs, application programs, a web browser, and the like.

The I/F 50 connects and controls various hardware, networks, and the like with the bus 90. The LCD 60 is a visual user interface for the user to check a status of the paper ejection apparatus 103. The operation unit 70 is a user interface for the user to input information to the paper ejection apparatus 103, such as a keyboard and a mouse.

The dedicated device 80 is hardware for performing a dedicated function in the paper ejection apparatus 103, the printer 101, the inspection device 102, the DFE 104, the client 201, and the server 202. In the case of the printer 101, the dedicated device 80 is a conveying mechanism for conveying the paper to which the image is output and formed, or a plotter device for performing the image forming output on the surface of the paper. In the case of the inspection device 102, the dedicated device 80 is a dedicated computing device for performing high-speed image processing. Such a computing device may be configured as an ASIC (Application Specific Integrated Circuit), for example. The reading device 131 for reading the image output on the surface of the paper is also implemented by the dedicated device 80.

In such a hardware configuration, a software controller is configured by the CPU 10 performing computing according to the program stored in the ROM 30 or the program read from the recording medium such as the HDD 40 or an optical disk to the RAM 20. In combination with the software controller configured in this manner and the hardware, a function block is configured to implement the functions of the paper ejection apparatus 103, the printer 101, the inspection device 102, the DFE 104, the client 201, and the server 202 according to the present embodiment.

<Information Transmitted between Devices>

Figure 5:
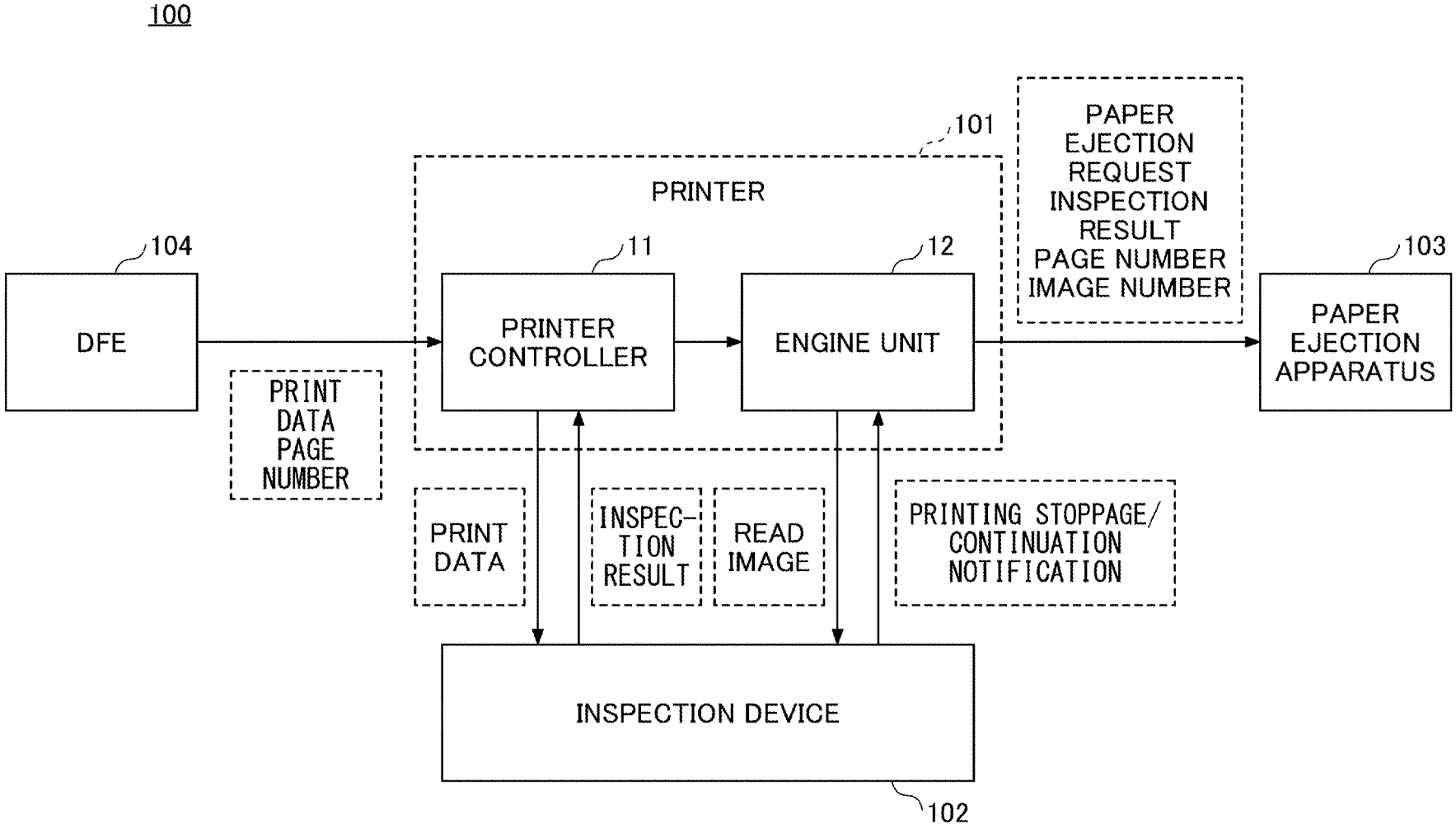
FIG. 5 is a diagram illustrating an overall configuration of the image forming system and an example of information transmitted within the image forming system.

FIG. 5 is a diagram illustrating an overall configuration of the image forming system 100 and information transmitted within the image forming system 100 according to the present embodiment.

The DFE 104 transmits the print data to be printed and page information based on the print job received from a client PC to the printer 101.

A printer controller 11 of the printer 101 transmits the print data received from the DFE 104 to the inspection device 102 as information that is a source of the image for inspection. The image for inspection is referenced when the inspection device 102 inspects a print result by the printer 101.

An engine unit 12 of the printer 101 performs image formation on a sheet-like member such as paper in accordance with the control of the printer controller 11, reads (scans) the output printed sheet by the reading device, and inputs the generated read image into the inspection device 102.

The sheet-like member may be a sheet-like material, such as paper, a film, or plastic. The sheet-like member may be an object to which the image is output and formed.

The inspection device 102 generates the master image with which the read image is to be compared, based on the print data input from the printer controller 11, and performs the inspection of the printed sheet by comparing the read image input from the engine unit 12 with the master image. The inspection device 102 returns the inspection result to the printer controller 11. When the inspection result is abnormal, the inspection device 102 may notify the engine unit 12 of printing stoppage. When the inspection result is normal, the inspection device 102 may notify the engine unit 12 of a continuation notification.

The engine unit 12 transmits the printed sheet to the paper ejection apparatus 103. The engine unit 12 transmits a paper ejection request, the inspection result, the page number, and an image number to the paper ejection apparatus 103.

The paper ejection apparatus 103 ejects the printed sheet on which the image is formed based on the paper ejection request, the inspection result, the page information, and image information. Details of the paper ejection control are described later.

<Configuration Example of Paper Ejection Trays and Main Tray>

Figure 6:
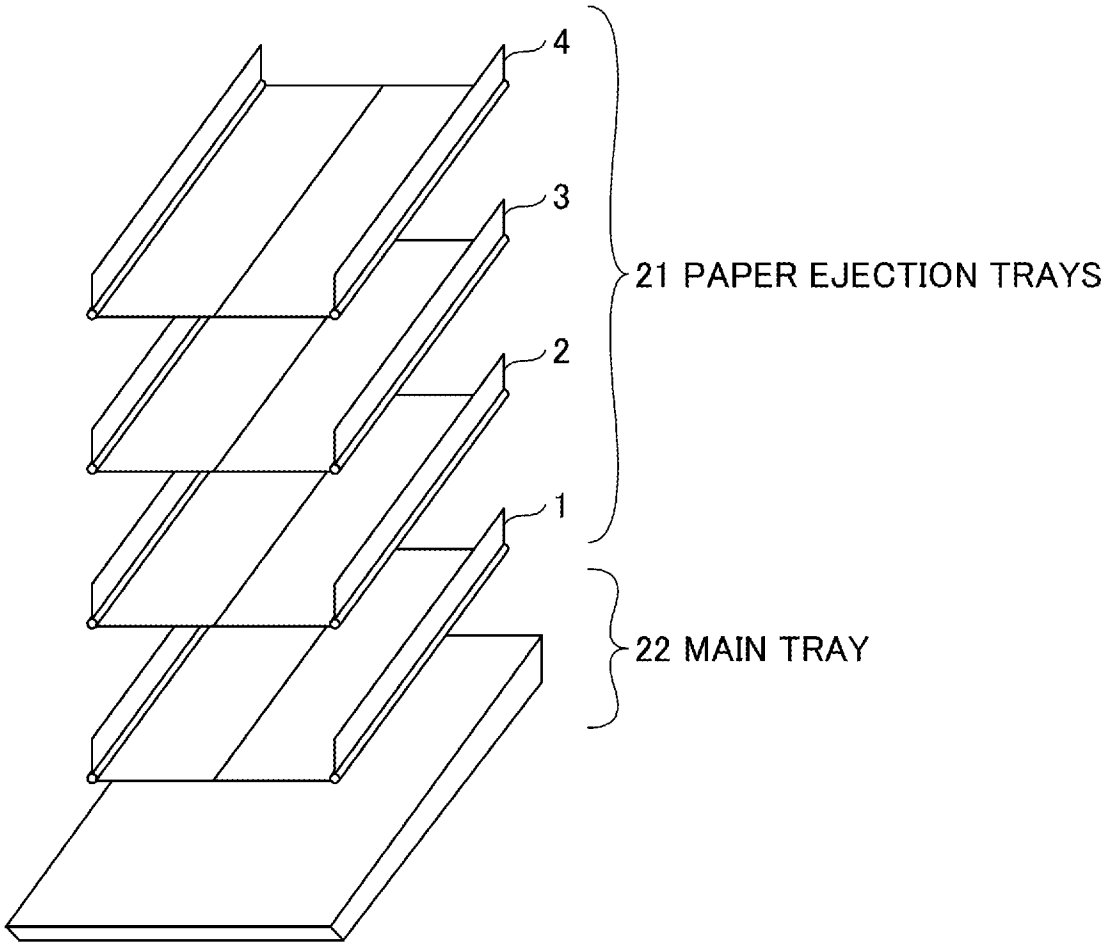
FIG. 6 is a diagram illustrating a configuration example of paper ejection trays and a main tray included in the paper ejection apparatus.

FIG. 6 is a diagram illustrating a configuration example of the paper ejection trays 21 and the main tray 22 included in the paper ejection apparatus 103. The paper ejection trays 21 are trays on which the printed sheets are temporarily ejected, and the main tray 22 is a tray for receiving the printed sheets (sheet-like member) that were moved downwardly in the vertical direction by the paper ejection trays. The user retrieves the printed sheet from the main tray 22.

The paper ejection trays 21 have a multi-stage configuration (in the drawing, four stages) and the main tray 22 is disposed lower than the paper ejection trays 21. For convenience, the paper ejection trays 21 are numbered 21-1, 21-2, 21-3, and 21-4 starting from that which is closest to the main tray 22 (from below). Since the number of the stages in the paper ejection trays 21 varies depending on usage and purpose of a printing apparatus, any number of the stages may be adopted. The paper ejection apparatus 103 can eject the printed sheet into any stage of the paper ejection trays 21 of the multi-stage configuration.

FIG. 7A to 7E are diagrams explaining a sorting operation. FIG. 7A to 7E are front views illustrating the paper ejection trays (only two stages are illustrated) and the main tray 22. FIG. 7A to 7E illustrate how the printed sheet is sorted over time.

Figure 7B:
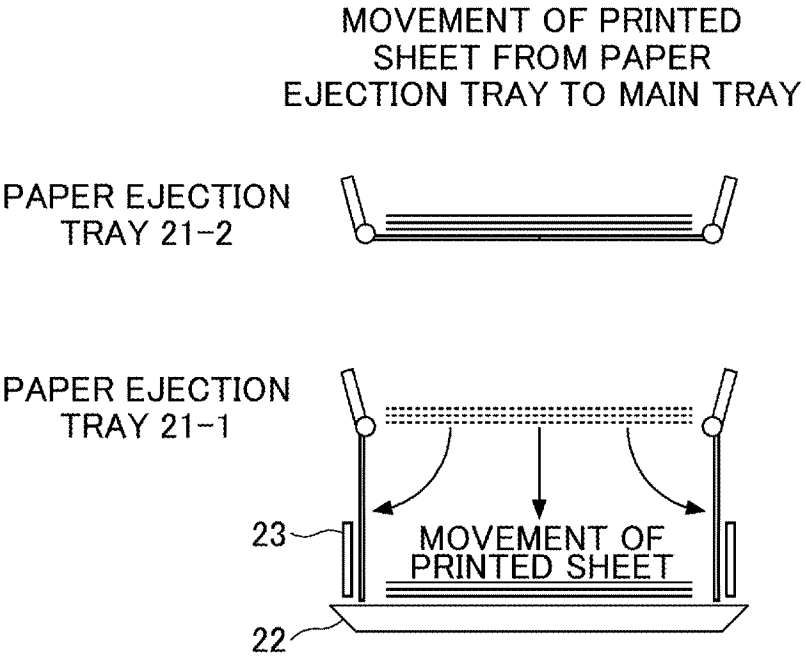
FIGS. 7A to 7E are examples of diagrams explaining a sorting operation.
Figure 7A:
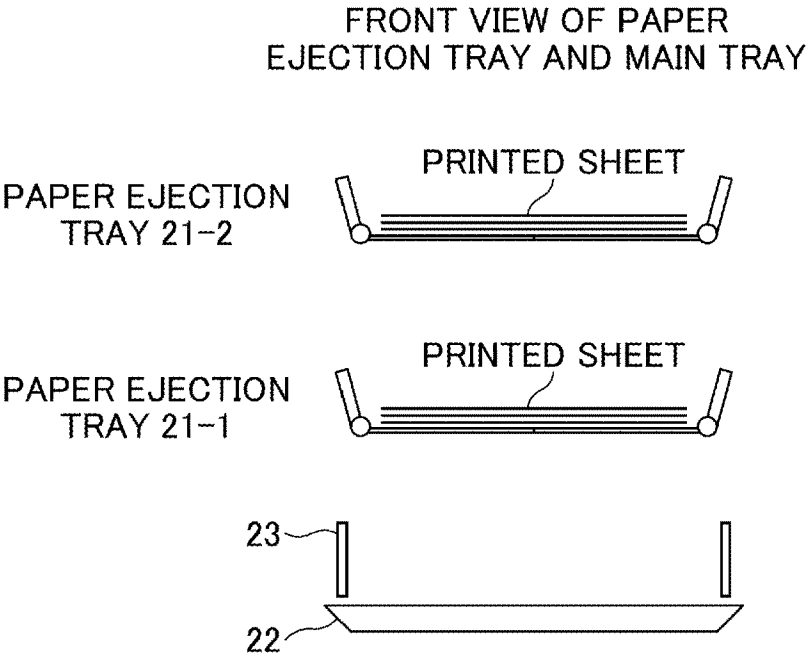

As illustrated in FIG. 7A, the ejected printed sheets are on the paper ejection tray 21-1 and the paper ejection tray 21-2.

FIG. 7B illustrates an operation in which the paper ejection apparatus 103 moves the printed sheet from the paper ejection tray 21-1 to the main tray 22. The paper ejection apparatus 103 opens the bottom surface of the paper ejection tray 21-1 and moves the printed sheet to the main tray 22.

Figure 7D:
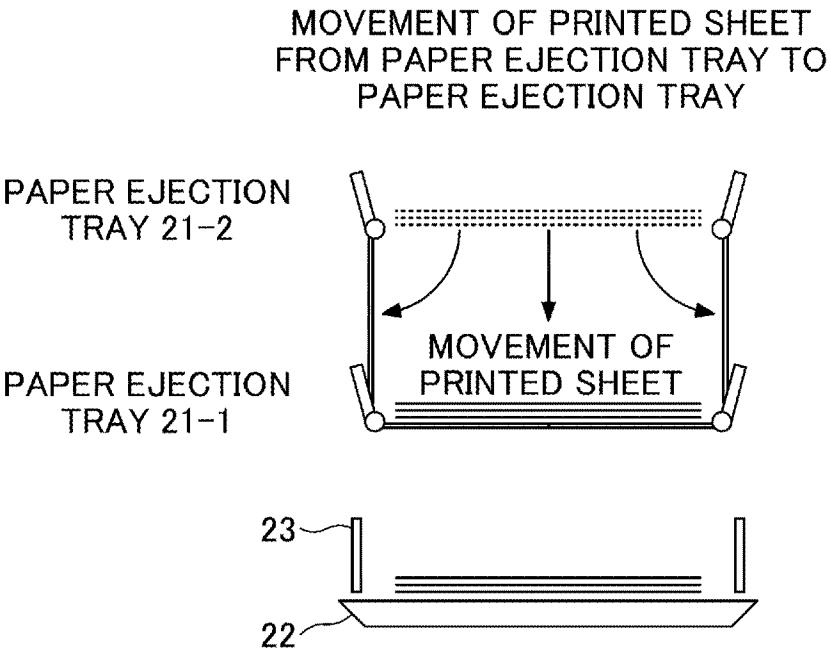
Figure 7C:
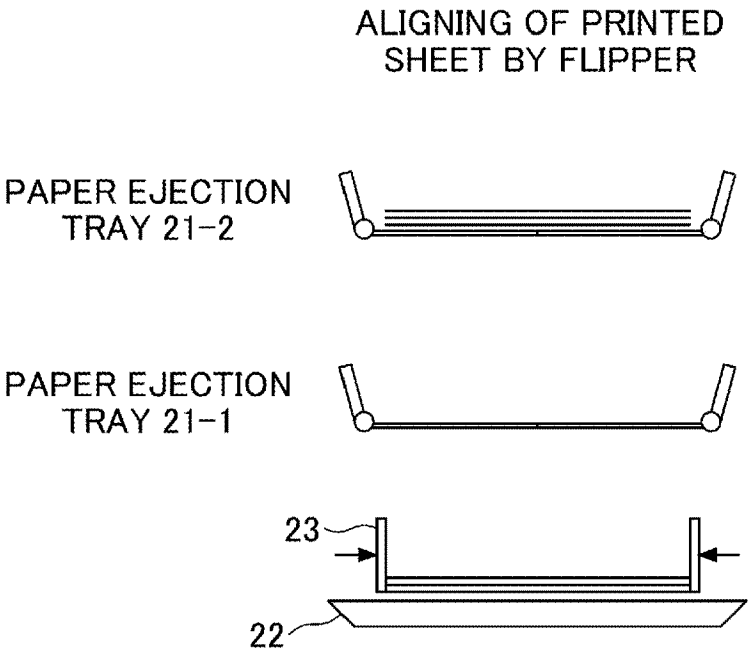

FIG. 7C illustrates an operation of aligning the positions of the printed sheet moved by the paper ejection apparatus 103 to the main tray 22 using a flipper 23.

FIG. 7D illustrates an operation in which the paper ejection apparatus 103 moves the printed sheet from the paper ejection tray 21-2 to the paper ejection tray 21-1 on the lower stage. In FIG. 7D, the paper ejection apparatus 103 moves the printed sheet from the paper ejection tray 21-2 to the paper ejection tray 21-1, but the same applies to the paper ejection trays higher than the paper ejection tray 21-2.

Figure 7E:
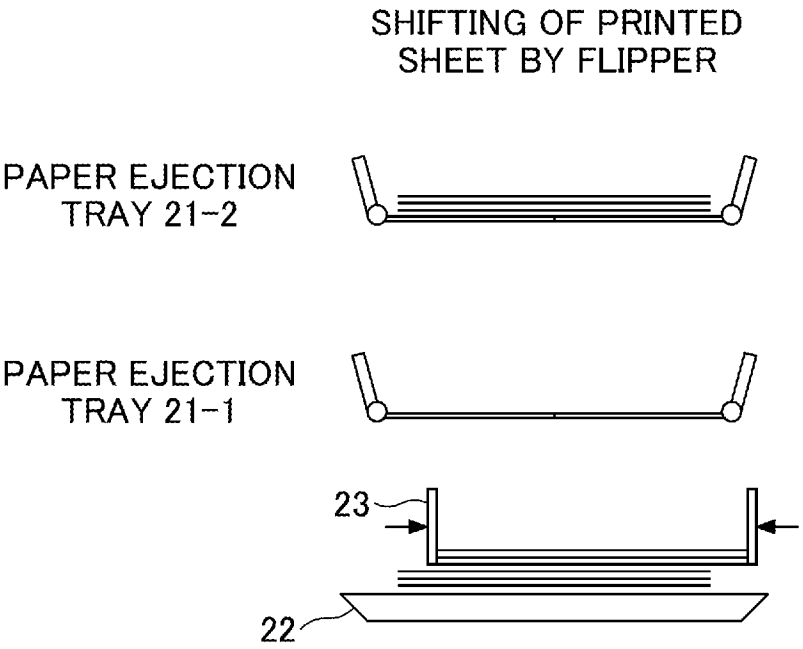

FIG. 7E illustrates an operation in which the paper ejection apparatus 103 shifts the printed sheet moved to the main tray 22 using the flipper 23. When the inspection result of the printed sheet on the paper ejection tray 21-2 is NG (abnormal), the paper ejection apparatus 103 shifts the position of the printed sheet with the abnormal inspection result from the position of the printed sheet with the normal inspection result, so that the user can easily identify the printed sheet with the abnormal inspection result from the printed sheet with the normal inspection result.

By the operation illustrated in FIG. 7D, the paper ejection apparatus 103 moves the printed sheet to the lower tray. As a result, there is no printed sheet on the higher paper ejection tray, and the tray becomes empty. The paper ejection apparatus 103 ejects the reprinted printed sheet to the empty paper ejection tray. This makes it possible to insert the reprinted printed sheet into the paper ejection tray which is lower than the paper ejection tray for the later page than the reprinted page. The printed sheets are moved from top to bottom of the paper ejection trays. Accordingly, the order of the printed sheet throughout the print job can be maintained by the paper ejection apparatus 103.

The paper ejection apparatus 103 distinguishes the printed sheet with the abnormal inspection result from the printed sheet with the normal inspection result by shifting the printed sheet with the abnormal inspection result from the printed sheet with the normal inspection result. This does not necessarily have to be done on a sheet-by-sheet basis. Shifting may be performed in a loaded state in which the printed sheets with the abnormal and normal inspection results are mixed. When the paper ejection apparatus 103 shifts the printed sheet in a unit of three sheets, two of the printed sheets with the normal inspection results and one of the printed sheet with the abnormal inspection result may be shifted together, for example. In this case, reprinting is performed in the unit of three sheets, and the user can remove the printed sheet with the abnormal inspection result in the unit of three sheets.

Similarly, it is not necessary to match the number of the printed sheets on one paper ejection tray ejected by the paper ejection apparatus 103 with the maximum number of the printed sheets that can be loaded on one paper ejection tray. For example, when the number of the printed sheets to be ejected by the paper ejection apparatus 103 on one paper ejection tray is three, and the maximum number of the printed sheet that can be loaded is nine, the paper ejection apparatus 103 can move three units (in the unit of three sheets) of the printed sheet to one paper ejection tray.

Increasing the number of sheets of the printed sheet ejected on one paper ejection tray by the paper ejection apparatus 103 also increases the number of sheets per unit inspected. Accordingly, increasing the number of the printed sheets ejected into one paper ejection tray has an advantage of reducing the number of stages of the paper ejection trays by increasing the acceptable number of the printed sheet with the abnormal inspection result. However, there is a disadvantage that the number of sheets reprinted by the paper ejection apparatus 103 increases. The number of sheets per unit to be ejected, or the number of sheets per inspection may be changed arbitrarily by the user depending on the configuration of the entire system and the application.

In FIG. 7, as a means for moving the printed sheet, the paper ejection apparatus 103 opens the bottom of one of the paper ejection trays 21 in a lateral direction with respect to the front surface of the paper ejection trays. The paper ejection apparatus 103 can also open the bottom of each of the paper ejection trays 21 in a front-back direction with respect to the front surface of the paper ejection trays. The paper ejection apparatus 103 may slide the printed sheet by tilting each of the paper ejection tray without opening it.

In FIG. 7, the flipper 23 is used to adjust the position of the printed sheet. The paper ejection apparatus 103 may also perform the shifted moving by moving at least one stage of the paper ejection trays 21 or the main tray 22 and changing their positional relationship. The paper ejection apparatus 103 may change the positional relationship of the paper ejection trays 21 or the main tray 22 by moving them in a front-back direction, instead of in a lateral direction.

Thus, the means for adjusting the positional relationship of the printed sheet is not limited. For example, the paper ejection apparatus 103 may be implemented by adjusting the direction of sliding of the printed sheet by shifting the opening timing.

In the present embodiment, the printed sheet with the abnormal inspection result and the printed sheet with the normal inspection result are relatively shifted by the paper ejection apparatus 103 thereby enabling the user to distinguish between the printed sheet with the abnormal inspection result and the printed sheet with the normal inspection result. Alternatively, a place for disposing the printed sheet with the abnormal inspection result may be provided next to the main tray 22, and the printed sheet with the abnormal inspection result may be removed from the main tray 22 to this disposal place by the flipper 23, etc. In this case, it is more desirable because the user does not need to remove the printed sheet with the abnormal inspection result.

<Example of Main Tray after Sorting>

Figure 8:
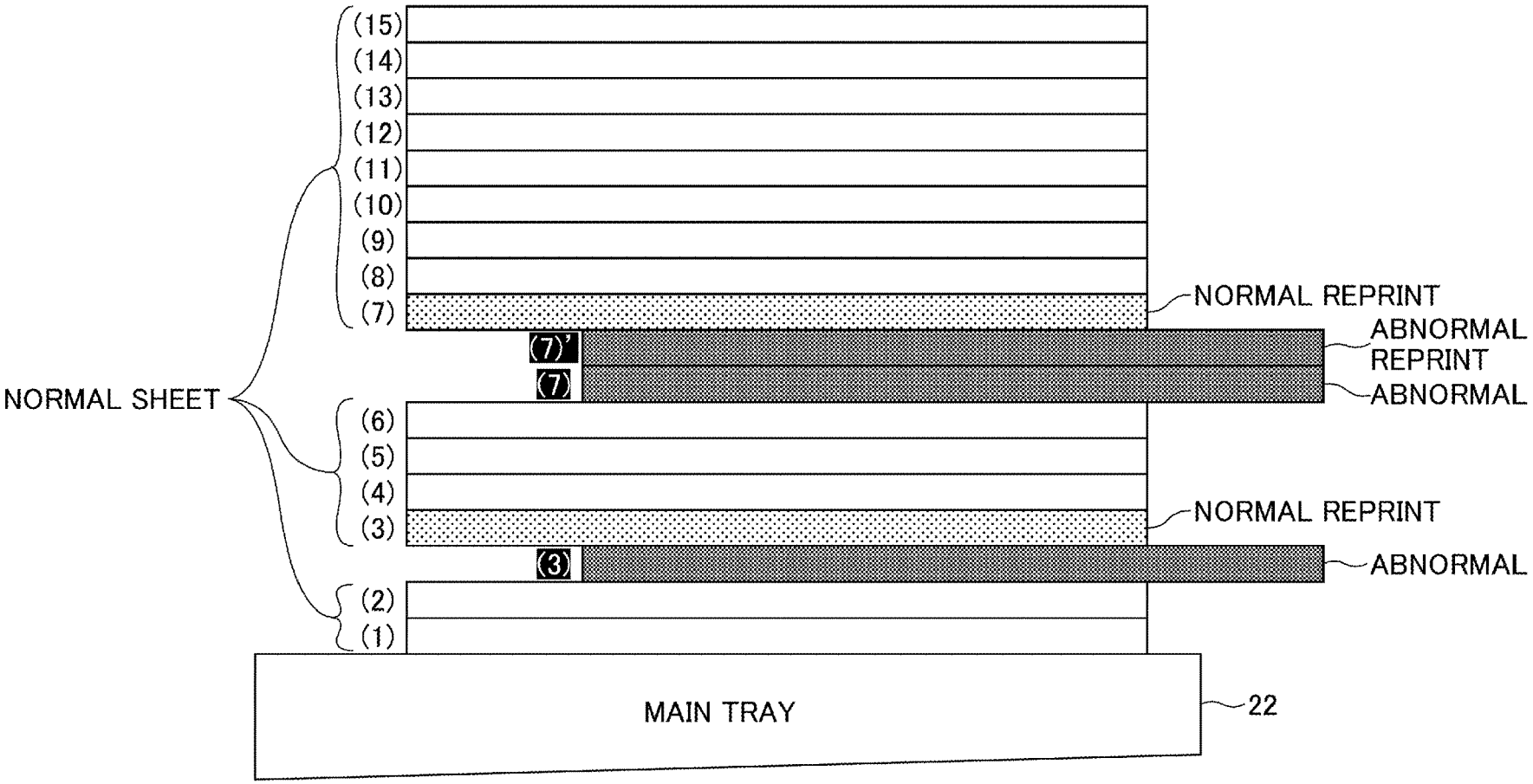
FIG. 8 is a diagram illustrating a state of printed sheets on the main tray for which the sorting operation is completed.

FIG. 8 is an example of a state of the printed sheets on the main tray 22 for which the sorting operation is completed. In FIG. 8, the printed sheets of pages 1 to 15 are on the main tray 22. Because the pages 3 and 7 are determined to be abnormal on the inspection results, they are placed on the main tray 22 in a state shifted from the printed sheets with the normal inspection results. Further, a first reprint of the page 3 was determined to be normal, but a first reprint of the page 7 was determined to be abnormal.

Thus, a second reprint of the page 7 was performed by the printer controller 11.

The printer controller 11 may perform such shifting and reprinting not in a unit of one printed sheet but in a unit of any number of the printed sheets.

<Function of Paper Ejection Apparatus>

Figure 9:
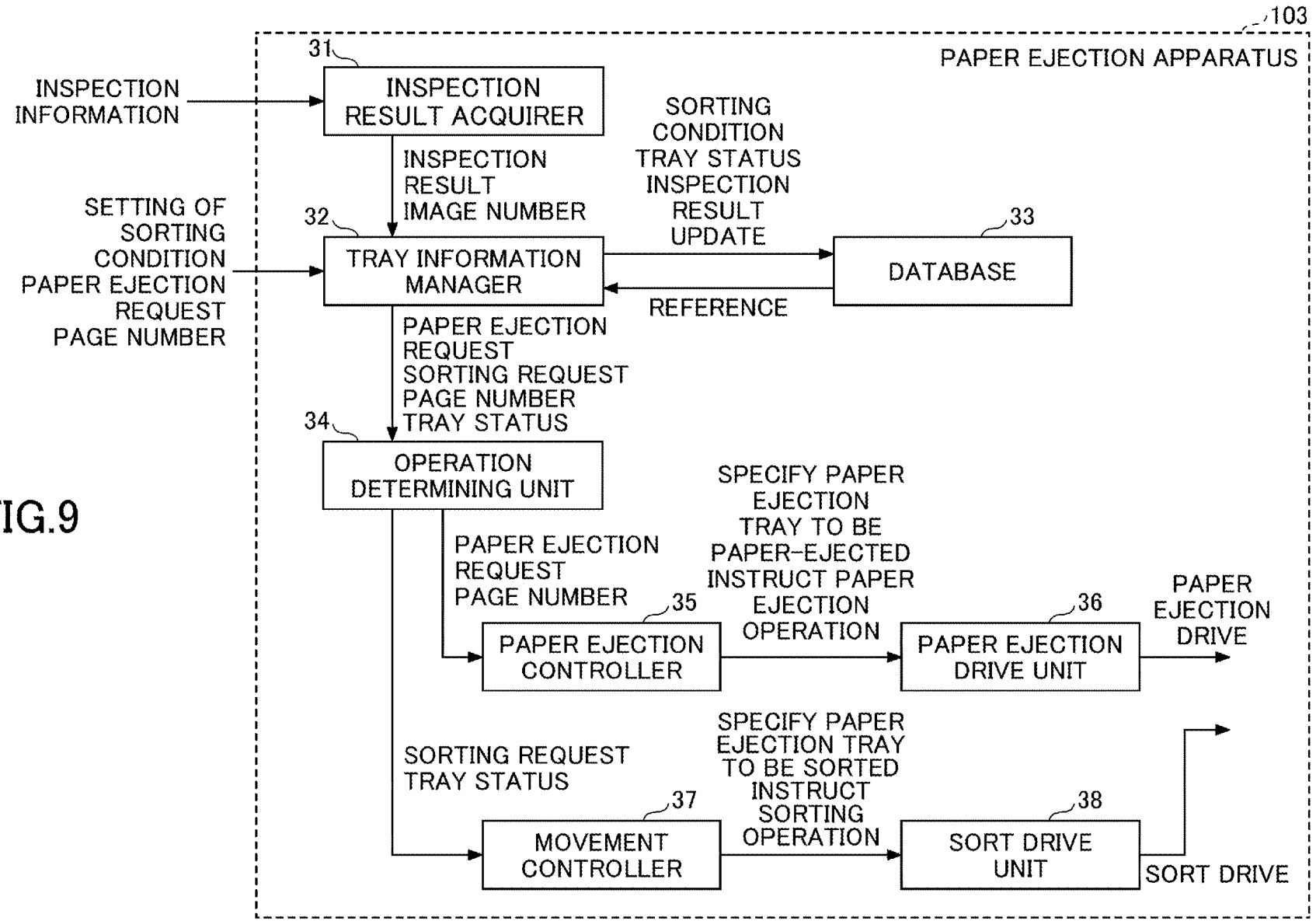
FIG. 9 is an example of a functional block diagram illustrating functions of the paper ejection apparatus by blocks.

FIG. 9 is an example of a functional block diagram illustrating functions of the paper ejection apparatus 103 by blocks. The paper ejection apparatus 103 includes an inspection result acquirer 31, a tray information manager 32, a database 33, an operation determining unit 34, a paper ejection controller 35, a paper ejection drive unit 36, a movement controller 37, and a sort drive unit 38.

Each of these functions included in the inspection device 102 is a function or a means implemented by operating any of the components illustrated in FIG. 4 by an instruction from the CPU 10 according to a program loaded from the HDD 40 to the RAM 20.

The inspection result acquirer 31 receives inspection information (the image number and the inspection result for each page number) from the inspection device 102. The inspection result acquirer 31 transmits the image number and the inspection result to the tray information manager 32. The image number is a unique identification number of the printed sheet.

The tray information manager 32 receives setting information of the sorting condition, the paper ejection request, and the page number from the printer controller 11. The tray information manager 32 receives the inspection result and the page number (and may also receive the image number) from the inspection result acquirer 31. The sorting condition includes, depending on the entire system of the printer 101, the setting of the number of the printed sheets to be reprinted, the number of times reprinting is allowed, the sorting operation according to the type of the printed sheet (paper thickness and size), and information about the entire settings relating to the sorting operation. The page number is the identification information of the page included in the print job and is used to identify each of the paper ejection trays at the time of reprinting, and so on. If the page number is reprinted, it is not unique but redundant. The tray information manager 32 manages and updates statuses of the paper ejection trays on the database 33 based on the information received from the printer controller 11 and the inspection result acquirer 31. The tray information manager 32 updates the correspondence between the identification information of each of the paper ejection trays and the inspection result in response to the movement of the printed sheet by the movement controller. The tray information manager 32 outputs a sorting request or the paper ejection request to the paper ejection trays based on the tray information.

The operation determining unit 34 receives the paper ejection request (instructing one of the paper ejection trays), the sorting request (instructing one of the paper ejection trays to be sorted), the page number, and the tray status from the tray information manager 32. The operation determining unit 34 determines the operation timing of the paper ejection apparatus 103, and allocates the requests to the paper ejection controller 35 and the movement controller 37, based on the information. The operation timing is, for example, an exclusion control that prioritizes the previously requested instruction so that the paper ejection and the sorting are not executed simultaneously in the same paper ejection tray. The operation determining unit 34 does not need to receive the tray status from the tray information manager 32. It is because the paper ejection request and the sorting request are instructed based on the tray status by the tray information manager 32. Note that when the operation determining unit 34 receives the tray status, it is possible to determine whether each of the paper ejection trays is actually empty or not.

The paper ejection controller 35 transmits information about the paper ejection tray of the printed sheet and the paper ejection instruction to the paper ejection drive unit 36 based on the paper ejection request. The paper ejection drive unit 36 performs paper ejection into the specified paper ejection tray in accordance with the paper ejection instruction. The specified paper ejection tray can be switched by driving up and down the paper ejection trays, or by switching the conveying path. The conveying path which can be switched may be provided in either the printer 101 or the paper ejection apparatus 103. It is desirable to provide the conveying path in the paper ejection apparatus 103 independently from the printer 101, since it is not necessary to combine the conveying path with the printer 101 and versatility is improved.

The movement controller 37 transmits, based on the sorting request, the information about the paper ejection tray which is to be sorted, a type of sorting (shift or not shift), and a sort instruction to the sort drive unit 38. The sort drive unit 38 drives the paper ejection tray which is to be sorted in accordance with the sort instruction.

<Tray Information Managed in Database>

<Information Managed by Tray Information>

Figure 10:
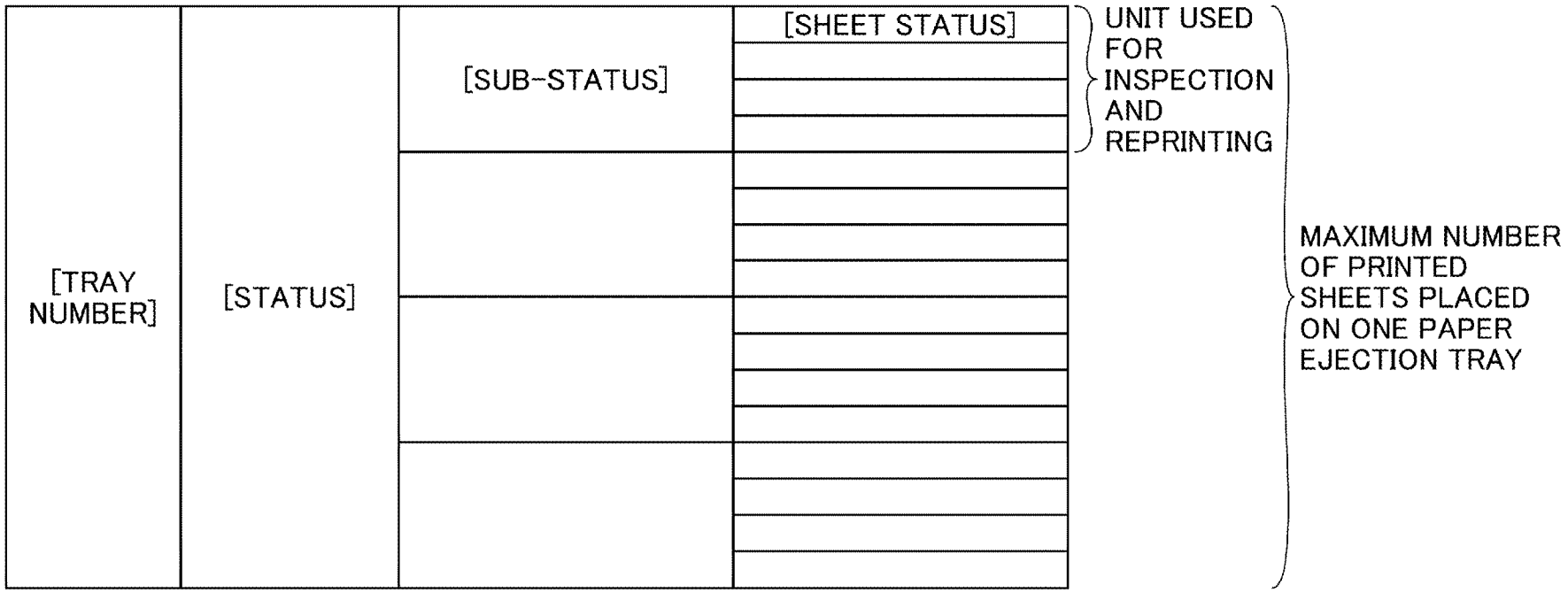
FIG. 10 is a diagram illustrating an example of tray information managed by a tray information manager.

FIG. 10 is a diagram illustrating an example of tray information managed by the tray information manager 32. The tray information has a tray number, a status, a sub-status, and a sheet status. In FIG. 10, 4×4=16 is the maximum number of printed sheets that can be placed on one paper ejection tray. A unit of four sheets is used for quality inspection and reprinting. These numbers 4 and 16 are only examples for illustrative purposes, and can be set by a user or the like.

Tray number

The tray number is the number of each of the paper ejection trays. In the present embodiment, the lowermost paper ejection tray near the main tray 22 is the paper ejection tray 21-1. Each of the paper ejection trays 21 has a number that increases in order toward the upper side.

Status

The status indicates the status of each of the paper ejection trays. In the present embodiment, there are seven types of statuses as described below.

A status is associated to a tray number. Each of the paper ejection trays must have one of the statuses. [Paper ejection] The status of the paper ejection tray, in which the printed sheet (not the reprinted one) is to be ejected to the tray in turn in the normal printing order.

[Re-print] The status of the paper ejection tray which is reserved or secured, in which the reprinted printed sheet is to be ejected to the tray.

[Inspection] The status of the paper ejection tray, in which the printed sheet is ejected by a specified number of units of sheets (or, the specified number of sheets) to the trays with the [Paper ejection] status or the [Re-print] status, and the inspection result is awaiting to be confirmed.

[OK] The status of the paper ejection tray in which all of the printed sheets retained on the paper ejection tray with the [Inspection] status are found to be normal as a result of the inspection.

[NG] The status of the paper ejection tray, in which one or more of the printed sheets retained on the paper ejection tray with the [Inspection] status is found to be abnormal as a result of the inspection.

[NR] The status of the lower paper ejection tray, in which the printed sheet is moved to the tray from the tray with the [NG] status. The [NR] status means that the paper ejection tray for reprinting is reserved (or secured).

[Standby] The status of the paper ejection tray with no printed sheet. In the present embodiment, all paper ejection trays other than the above-described six types of the statuses are set to the [Standby] status.

Sub-status

Figure 22:
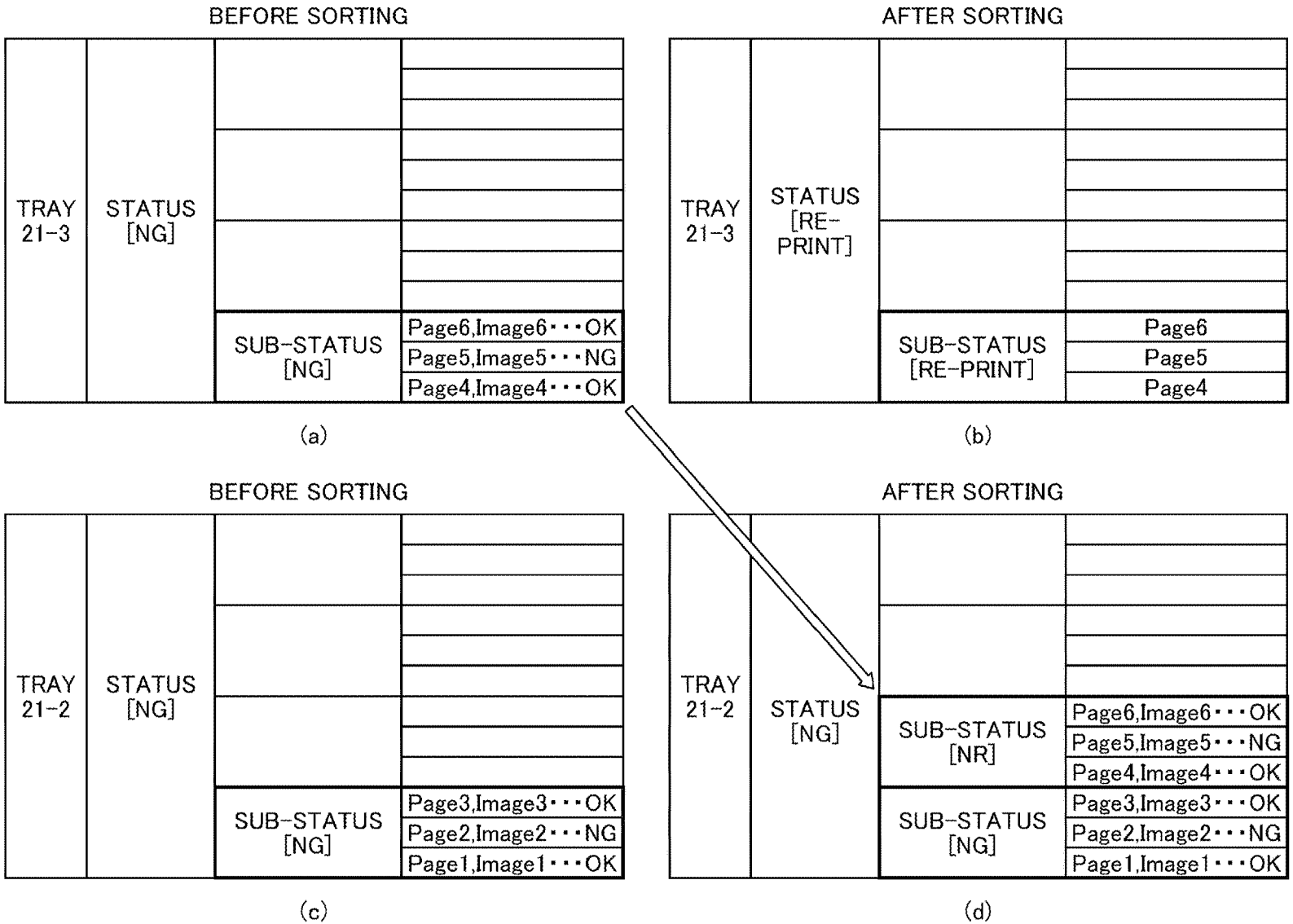
FIG. 22 is a diagram illustrating a change in the status of the paper ejection tray resulting from the sorting operation.

A sub-status is information for determining whether or not reprinting is necessary for each of the predetermined units of the printed sheets. The sub-status is used, for example, when the printed sheets of the paper ejection trays with the [OK] statuses are moved to one paper ejection tray, and the printed sheets of the paper ejection tray with the [NG] status and the paper ejection tray with the [NR] status are moved to one paper ejection tray, by the paper ejection apparatus 103 in the sorting operation. The sub-status is set to any one of <OK>, <NG>, or <NR>because the status information is maintained as that of the paper ejection tray before the printed sheets to be reprinted are moved by the paper ejection apparatus 103. The sub-status is further described by example as illustrated in FIG. 22.

Sheet status

A sheet status refers to the status of the printed sheet ejected into each of the paper ejection trays. The sheet status has two types of identification numbers (the page number, and the image number) and three types of inspection information (OK, NG, and inspection) of the printed sheet.

[Page Number] is a number by which the ejected printed sheet and job information are associated to each other. The reprinted printed sheet is ejected to one of the paper ejection tray to which the printed sheet having the same page number as the reprinted printed sheet was ejected.

[Image Number] is a unique number of the printed sheet ejected. The image numbers do not overlap.

[OK] is the printed sheet with normal inspection results.

[NG] is the printed sheet with abnormal inspection results.

[Inspection] is the printed sheet for which the inspection result is not confirmed.

«Movement Control from Paper Ejection Tray 21-1 to Main Tray»

FIG. 11A is a table which explains the sorting operation from the paper ejection tray 21-1 to the main tray 22, which is explained later with reference to FIG. 16. The tray information manager 32 manages the status of each of the paper ejection trays by the tray information illustrated in FIG. 10. The tray information manager 32 moves the printed sheet with the normal inspection result and the printed sheet with the abnormal inspection result in a distinguishable state, from the paper ejection tray 21-1] on the lowermost stage to the main tray 22, based on the table of FIG. 11A.

«Movement Control from Paper Ejection Tray 21-S to Paper Ejection Tray 21-5-1»

FIG. 11B is a table which explains the sorting operation of the paper ejection trays 21-2 to 21-4, which is explained later with reference to FIG. 17. When focusing on the two paper ejection trays that are vertically continuous, the row heading is the status of the lower paper ejection tray 21-S-1, and the column heading is the status of the higher paper ejection tray 21-S. The tray numbers are in ascending order from below.

The tray information manager 32 manages the status of each of the paper ejection trays with the tray information illustrated in FIG. 10. The tray information manager 32 controls the movement of the printed sheet from the S-th paper ejection tray (That is, the tray at the S-th position from below) to the S-1-th paper ejection tray in accordance with a combination of the statuses of the S-th paper ejection tray and the S-1-th paper ejection tray.

The tables of FIG. 11A and 11B are stored in the database 33.

<Example of Sorting Operation>

Hereinafter, the information and algorithms necessary for realizing the paper ejection operation and the sorting operation will be described. In the following, when the paper ejection tray 21-S is described, the 21-S represents the number of the paper ejection tray to be sorted. The 21-S-1 indicates the number of the paper ejection tray which is one stage below the paper ejection tray to be sorted.

«Overall Operation»

Figure 12:
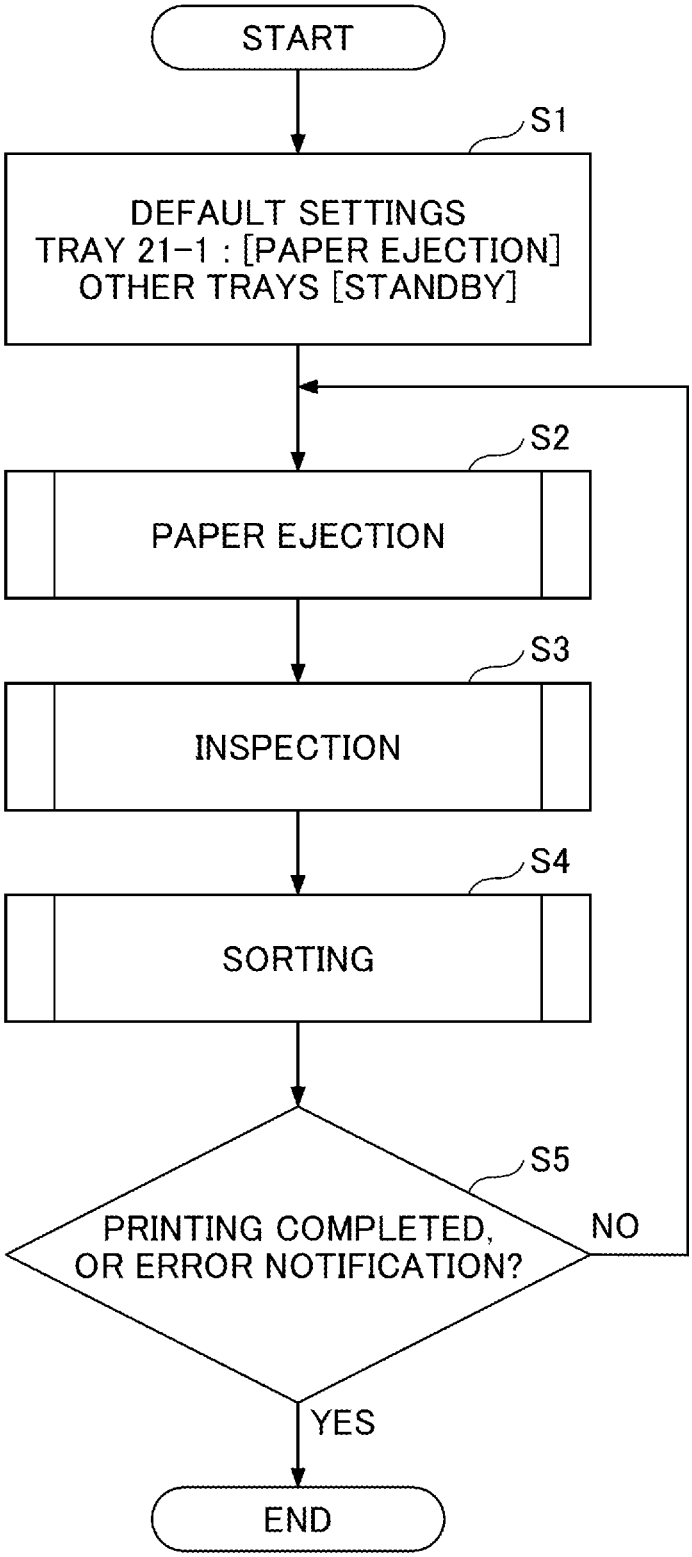
FIG. 12 is an example of a flowchart illustrating the overall operation of the paper ejection apparatus.

FIG. 12 is an example of a flowchart illustrating the overall operation of the paper ejection apparatus 103. The process illustrated in FIG. 12 starts with the power on of the paper ejection apparatus 103.

S1: The tray information manager 32 performs default settings for the status of each of the paper ejection trays. That is, the tray information manager 32 sets the status of the paper ejection tray 21-1 to [Paper Ejection], and the Status of other Paper Ejection Trays to [Standby].

S2: The tray information manager 32 performs control relating to the paper ejection. The details will be described with reference to FIG. 13.

S3: The tray information manager 32 performs control relating to the inspection. The details will be described with reference to FIG. 14.

S4: The tray information manager 32 performs control relating to the sorting. The details will be described with reference to FIG. 15.

S5: The tray information manager 32 determines whether printing including the sorting operation is completed, or whether the printer 101 cannot continue operation due to an error notification, and in either case, the operation is terminated.

A period of time is required between the paper ejection of the printed sheet and the confirmation of the inspection result. Therefore, as illustrated in the flowchart of FIG. 12, the paper ejection apparatus 103 repeats the paper ejection, inspection, and sorting until all get completed. Depending on a processing speed of the paper ejection apparatus 103 and the statuses of each of the paper ejection trays, these orders may be changed, and a specific operation may be repeated a plurality of times.

«Paper Ejection»

Figure 13:
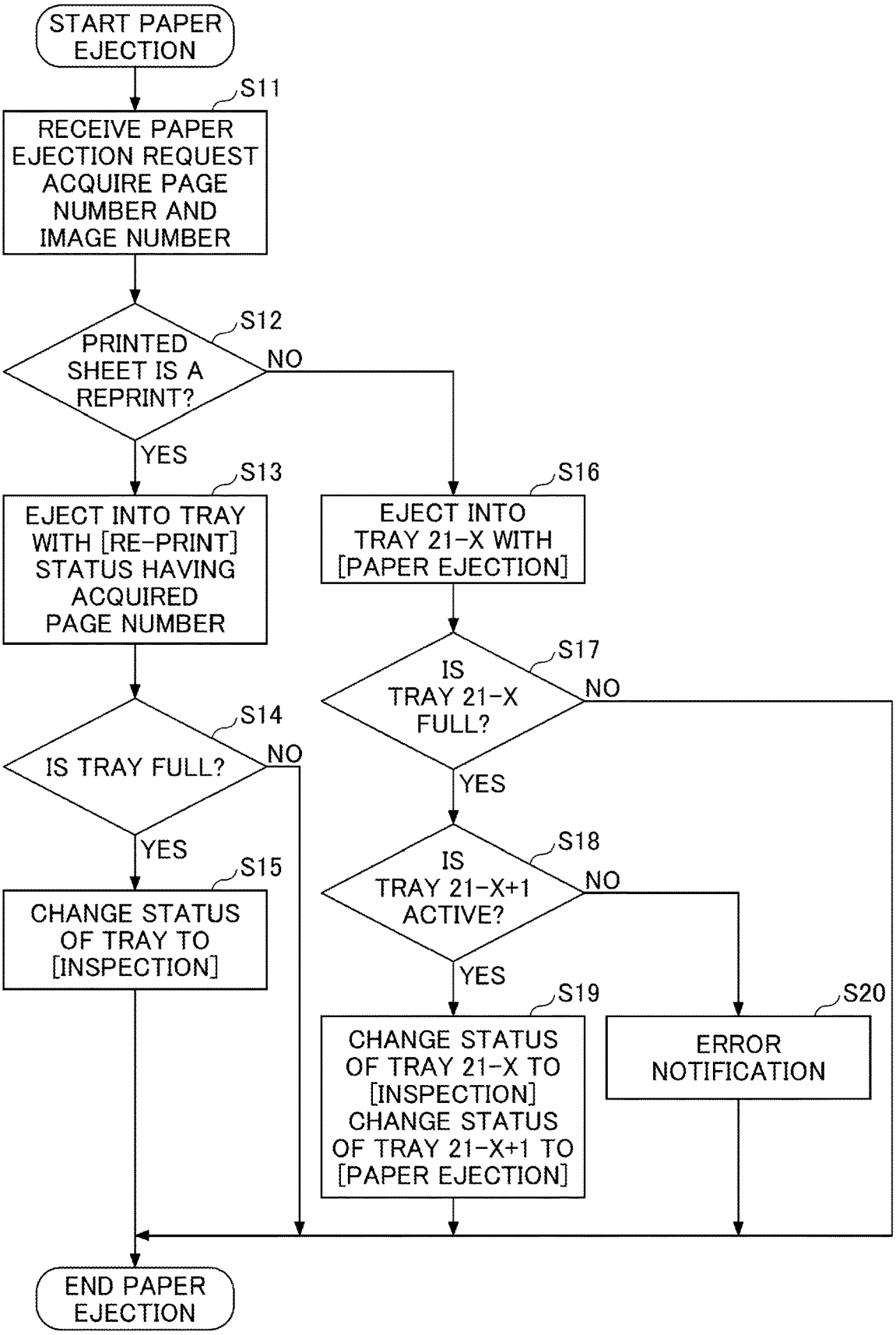
FIG. 13 is an example of a flowchart illustrating an operation in which the paper ejection apparatus performs the paper ejection.

FIG. 13 is an example of a flowchart illustrating an operation in which the paper ejection apparatus 103 performs the paper ejection.

S11: The tray information manager 32 acquires the paper ejection request, the page number, and the image number from the printer 101.

S12: The tray information manager 32 determines whether the printed sheet is a reprint based on the page number. The tray information manager 32 determines whether the same page number is registered in the tray information. Further, the tray information manager 32 may determine whether that page number is associated to any one of the paper ejection trays whose status is [Re-print].

S13: In the case of the reprinted printed sheet, the tray information manager 32 ejects the printed sheet into one of the paper ejection trays with the [Re-print] status. Specifically, the tray information manager 32 notifies the operation determining unit 34 of the paper ejection request, the page number, and the tray number.

S14: The tray information manager 32 determines whether or not the printed sheet can be ejected further into the paper ejection tray with the [Re-print] status. The tray information manager 32 compares a predetermined number of inspection sheets (the maximum predetermined number is the maximum load of the paper ejection tray) with the number of sheets registered in the tray information.

S15: When further paper ejection is impossible, the tray information manager 32 changes the status of the paper ejection tray to the [Inspection] status.

S16: When it is determined that the printed sheet is not a reprint in the step S12, the tray information manager 32 determines that the printed sheet is ejected into one of the paper ejection trays with the [Paper ejection] status. Specifically, the tray information manager 32 notifies the operation determining unit 34 of the paper ejection request, the page number, and the tray number. As described above, the tray information manager 32 ejects the printed sheets into the paper ejection trays before the inspection results of the printed sheets are confirmed.

S17: The tray information manager 32 determines whether or not the printed sheet can be ejected further into the paper ejection tray with the [Paper ejection] status. The tray information manager 32 compares the predetermined number of inspection sheets (the maximum predetermined number is the maximum load of the paper ejection tray) with the number of sheets registered in the tray information.

S18: When further paper ejection is impossible, the tray information manager 32 determines whether higher paper ejection tray of the paper ejection tray is active, meaning, whether the higher paper ejection tray is empty.

S19: When there is an active higher paper ejection tray, the tray information manager 32 changes the status of the higher paper ejection tray to the [Paper ejection] status, and changes the status of the paper ejection tray with the [Paper ejection] status to the [Inspection] status.

S20: When there is no active higher paper ejection tray and no more [Paper ejection] status can be allocated, the tray information manager 32 sends the error notification because printing cannot be continued. The error notification is sent to the printer 101, which interrupts or cancels printing. In this case, the printer 101 can resume printing if the paper ejection tray is empty.

«Inspection»

Figure 14:
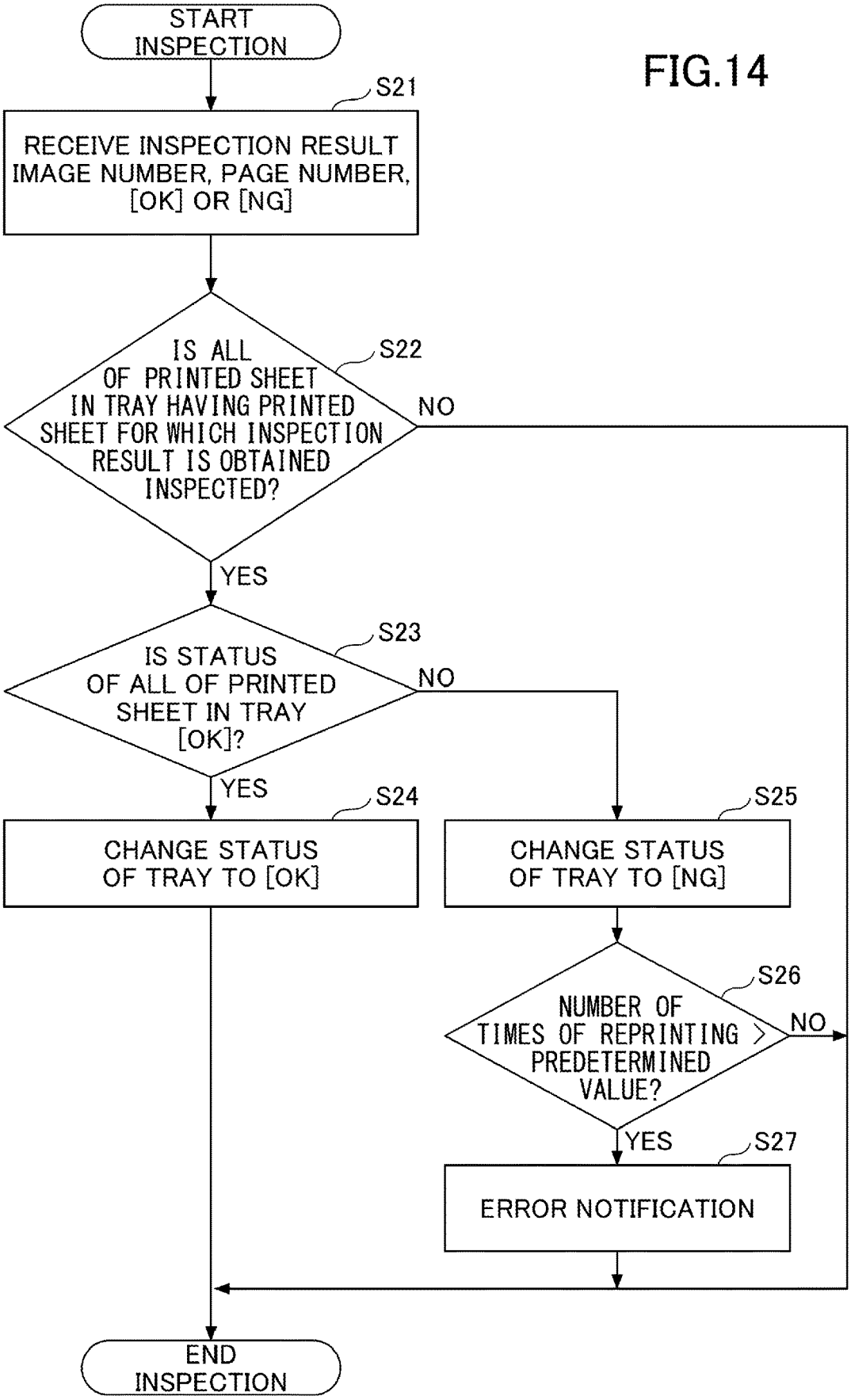
FIG. 14 is an example of a flowchart illustrating an operation in which the paper ejection apparatus updates the tray information according to an inspection result.

FIG. 14 is an example of a flowchart illustrating an operation in which the paper ejection apparatus 103 updates the tray information depending on the inspection result.

S21: The inspection result acquirer 31 acquires the inspection result, image number, and page number from the engine unit 12.

S22: The tray information manager 32 determines whether or not all of the printed sheets on the paper ejection tray having the printed sheets for which the inspection result was obtained is inspected. The tray information manager 32 can specify the paper ejection tray with the image number.

S23: The tray information manager 32 determines whether or not all of the printed sheets on the paper ejection tray is inspected and whether or not the status of the paper ejection tray is [OK].

S24: When the status of all of the printed sheets ejected into the paper ejection tray is [OK], the tray information manager 32 changes the status of the paper ejection tray to the [OK] status.

S25: When the status of at least one of the printed sheet ejected to the paper ejection tray is [NG], the tray information manager 32 changes the paper ejection tray to the [NG] status.

S26: The tray information manager 32 determines whether or not the number of times of reprinting exceeds a predetermined value.

S27: When the number of times of reprinting exceeds the predetermined value, the tray information manager 32 notifies the printer 101 of the error. If the printed sheet cannot be obtained within the predetermined number of times, the printer 101 may have some kind of failure or the like. So, this error leads to a request such as a cancellation of printing. Preferably, the printer 101 alerts a person in charge by e-mail or the like.

«Sorting»

Figure 15:
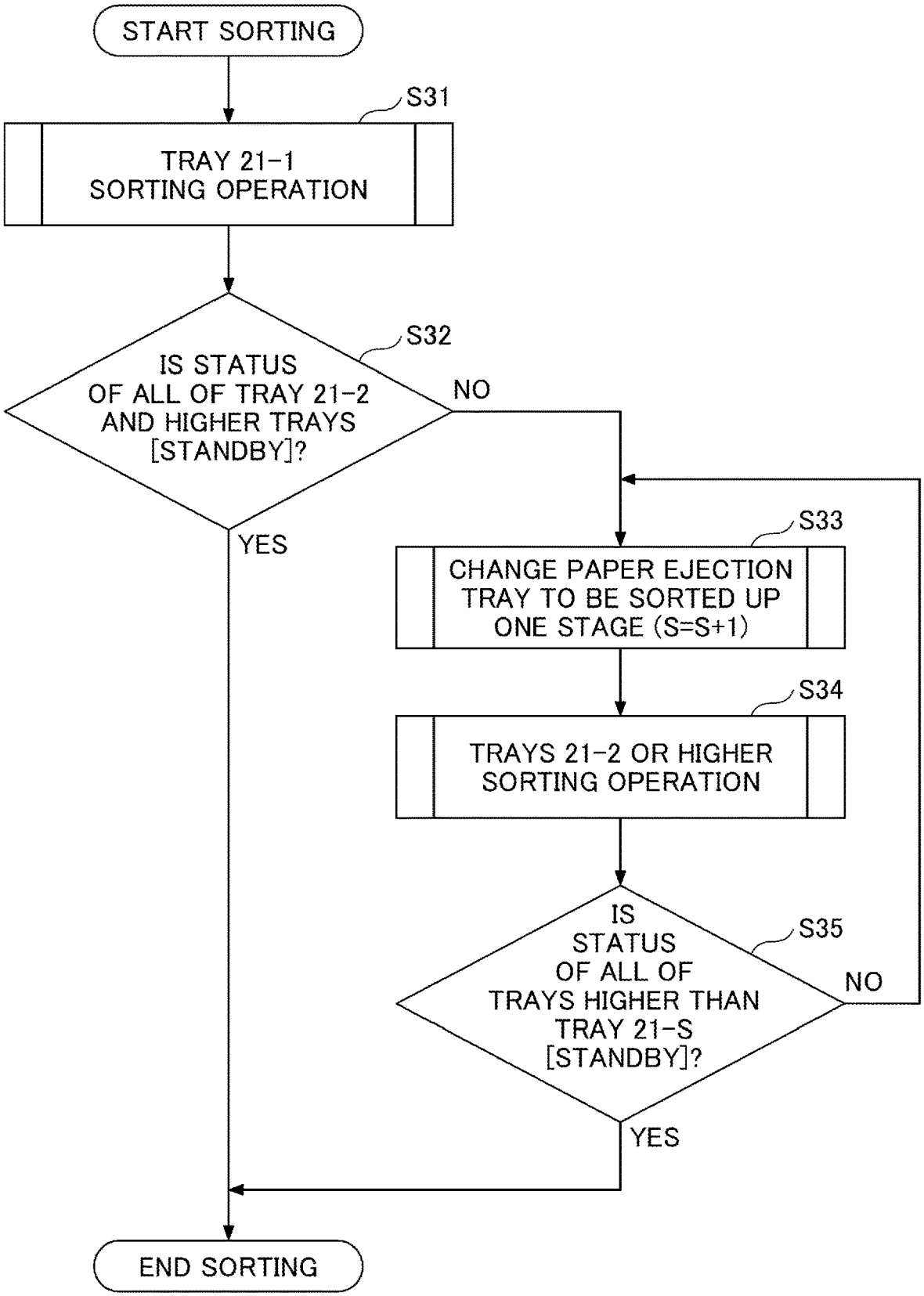
FIG. 15 is an example of a flowchart illustrating an overall operation in which the paper ejection apparatus sorts according to tray information.

FIG. 15 is an example of a flowchart illustrating an overall operation in which the paper ejection apparatus 103 sorts in accordance with the tray information.

S31: The paper ejection apparatus 103 performs the sorting operation of the paper ejection tray 21-1. The details will be described with reference to FIG. 16.

S32: When the sorting operation of the paper ejection tray 21-1 is completed, the tray information manager 32 determines whether or not the status of the paper ejection trays 21-2 to 21-4 which are the paper ejection trays higher than the paper ejection tray 21-1, is all [Standby].

S33: When the paper ejection tray not in the [Standby] status is present higher than the paper ejection tray 21-1, the tray information manager 32 changes the paper ejection tray to be sorted up one stage. When an initial value of the paper ejection tray 21-S is the paper ejection tray 21-1 (S=1), the tray information manager 32 determines the paper ejection tray of the paper ejection tray 21-2 (S=S+1=2) as the paper ejection tray to be sorted.

S34: The tray information manager 32 performs the sorting operation of the paper ejection tray to be sorted. The details will be described in FIG. 17.

S35: The tray information manager 32 determines whether all of the paper ejection trays higher than the paper ejection tray to be sorted are in the [Standby] status. Sorting is not required if all of the paper ejection trays higher than the paper ejection tray to be sorted are in the [Standby] status. When even one paper ejection tray higher than the paper ejection tray to be sorted is not in the [Standby] status, the process returns to the step S33.

In this way, the paper ejection apparatus 103 repeats sorting from the lower paper ejection tray to the higher paper ejection tray, one by one.

Figure 16:
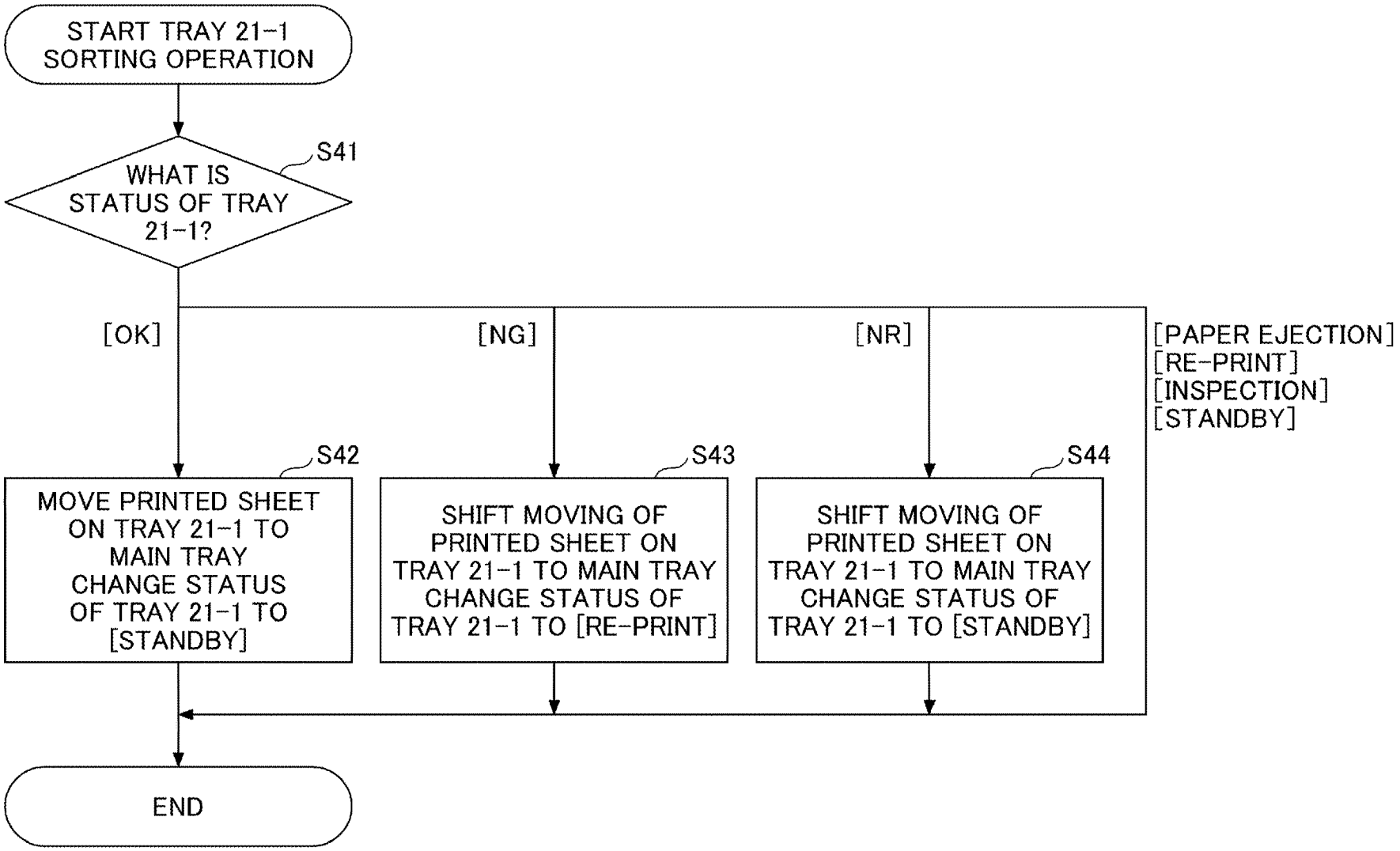
FIG. 16 is an example of a flowchart illustrating the movement of the printed sheet from the paper ejection tray 21-1 to the main tray by the paper ejection apparatus.

FIG. 16 is an example of a flowchart illustrating the movement of the printed sheet from the paper ejection tray 21-1 to the main tray 22 by the paper ejection apparatus 103.

S41: The tray information manager 32 checks the status of the paper ejection tray 21-1. As illustrated in FIG. 11A, if the status is any of [paper ejection], [Re-print], [Inspection], and [Standby], the paper ejection apparatus 103 cannot perform sorting. Therefore, the sorting operation of the paper ejection tray 21-1 is terminated.

S42: When the status of the paper ejection tray 21-1 is [OK], the tray information manager 32 moves the printed sheet on the paper ejection tray 21-1 to the main tray 22 and changes the status of the paper ejection tray 21-1 to the [Standby] status. The tray information manager 32 transmits the sorting request of the paper ejection tray 21-1 to the movement controller 37 via the operation determining unit 34. The movement controller 37 moves the printed sheet from the paper ejection tray 21-1 to the main tray 22.

S43: When the status of the paper ejection tray 21-1 is [NG], the tray information manager 32 performs the shifted moving of the printed sheet on the paper ejection tray 21-1 to the main tray 22 and changes the status of the paper ejection tray 21-1 to the [Re-print] status. The tray information manager 32 transmits the sorting request (the shifted moving) of the paper ejection tray 21-1 to the movement controller 37 via the operation determining unit 34. The movement controller 37 performs the shifted moving of the printed sheet from the paper ejection tray 21-1 to the main tray 22.

If the inspection result is abnormal, the inspection device 102 requests the printer 101 to reprint. Alternatively, when the status of the paper ejection tray is changed to the [Re-print] status, the tray information manager 32 specifies the page number corresponding to the paper ejection tray and requests the printer 101 to reprint. The same applies to the case where the status of the paper ejection tray is changed to the [Re-print] status in the following description.

When the tray information manager 32 requests reprinting, reprinting is requested after securing one of the paper ejection trays for reprinting. As a result, at the time of reprinting and the paper ejection, the paper ejection tray is always secured. However, since the request for reprinting is made after securing one of the paper ejection trays for reprinting, the reprinting cannot be requested when the inspection result NG is confirmed by the inspection device 102. Consequently, reprinting is performed later than the confirmation of the inspection result. This may cause sorting delays and increase the number of the paper ejection trays required.

If the inspection device 102 requires reprinting when the inspection result NG is confirmed, the paper ejection apparatus 103 needs to secure the paper ejection tray for reprinting before reprinting and the paper ejection is performed. In a high-speed printing apparatus, more than 10 printed sheets are flowing in the apparatus. Basically, the inspection device 102 first makes the request for reprinting, and then the paper ejection apparatus 103 secures the paper ejection tray for reprinting.

The status of each paper ejection tray is managed based on the tray information. The tray information manager 32 performs the shifted moving of the printed sheet on the paper ejection tray with the status of [NG]. Therefore, the paper ejection apparatus 103 can eject the printed sheet before the inspection result is confirmed.

S44: When the status of the paper ejection tray 21-1 is [NR], the tray information manager 32 performs the shifted moving of the printed sheet on the paper ejection tray 21-1 to the main tray 22 and changes the status of the paper ejection tray 21-1 to the [Standby] status. When the status is [NR], it is not necessary to reprint. The tray information manager 32 transmits the sorting request (the shifted moving) of the paper ejection tray 21-1 to the movement controller 37 via the operation determining unit 34. The movement controller 37 performs the shifted moving of the printed sheet from the paper ejection tray 21-1 to the main tray 22.

The status of each paper ejection tray is managed based on the tray information. The tray information manager 32 performs the shifted moving of the printed sheet on the paper ejection tray with the status of [NR]. Therefore, the paper ejection apparatus 103 can eject the printed sheet before the inspection result is confirmed.

Figure 17:
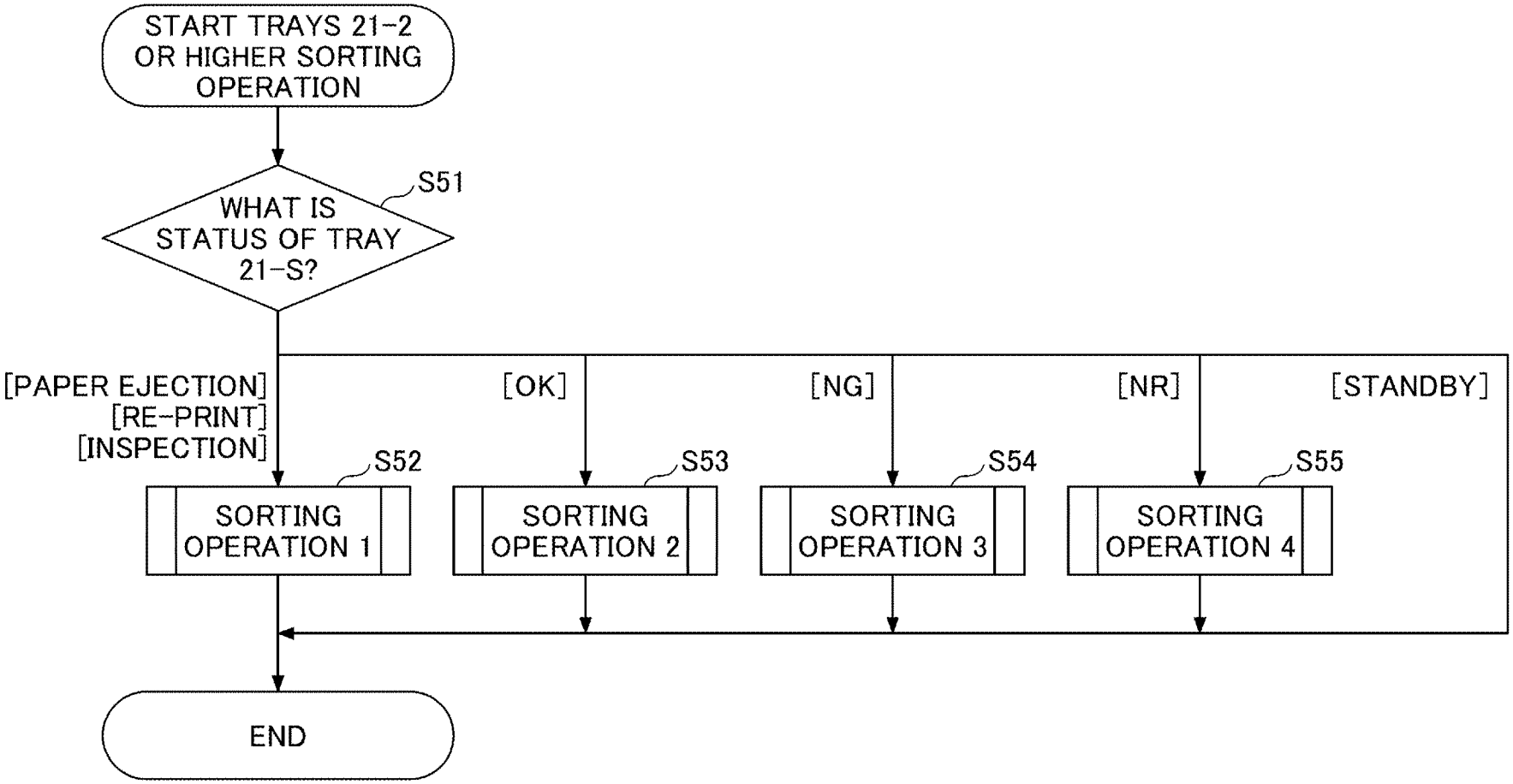
FIG. 17 is an example of a flowchart illustrating an operation in which the paper ejection apparatus sorts the paper ejection trays 21-2 to 21-4, which are the paper ejection trays higher than the paper ejection tray 21-1.

FIG. 17 is an example of a flowchart illustrating an operation in which the paper ejection apparatus 103 sorts the paper ejection trays 21-2 to 21-4, which are the paper ejection trays higher than the paper ejection tray 21-1.

S51: The tray information manager 32 checks the status of the paper ejection trays 21-2 to 21-4 to be sorted. If the statuses are [Standby], sorting operation is terminated because sorting is not required.

S52: When the status of the paper ejection tray to be sorted is any of [Paper ejection], [Re-print], or [Inspection], the sorting operation 1 is performed. The details will be described with reference to FIG. 18.

S53: When the status of the paper ejection tray to be sorted is [OK], the tray information manager 32 performs the sorting operation 2. The details will be described with reference to FIG. 19.

S54: When the status of the paper ejection tray to be sorted is [NG], the tray information manager 32 performs the sorting operation 3. The details will be described with reference to FIG. 20.

S55: When the status of the paper ejection tray to be sorted is [NR], the tray information manager 32 performs the sorting operation 4. The details will be described with reference to FIG. 21.

Figure 18:
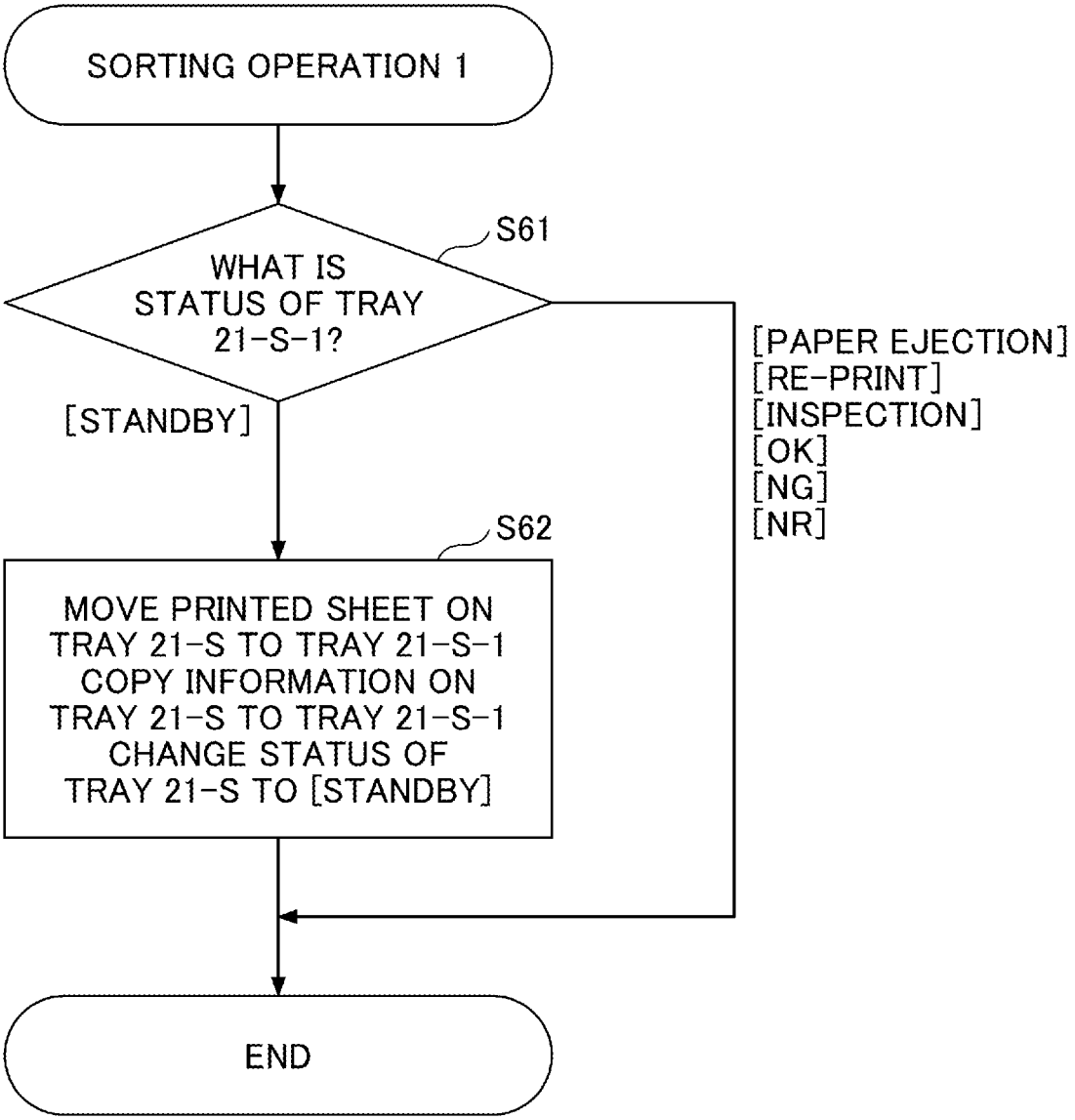
FIG. 18 is an example of a flowchart illustrating a sorting operation 1.

The sorting operations 1 to 4 will be described below. The sorting operations 1 to 4 described below are performed based on the table of FIG. 11B FIG. 18 is an example of a flowchart illustrating the sorting operation 1. The sorting operation 1 is a sorting operation when the status of the paper ejection tray 21-S (higher stage) to be sorted is [Paper ejection], [Re-print], or [Inspection].

S61: The tray information manager 32 checks the status of the paper ejection tray 21-5-1 at the lower stage than the paper ejection tray 21-S to be sorted. When the status of the paper ejection tray 21-5-1 is [Paper ejection], [Re-print], [Inspection], [OK], [NG], or [NR], the tray information manager 32 terminates the sorting operation 1 without moving the printed sheet from the paper ejection tray 21-S to the paper ejection tray 21-5-1. This is because, when the status of the paper ejection tray 21-5-1 is [Paper ejection], the printed sheets may collide or overflow. Also, this is to prevent the mixing printed sheets with different statuses when the status of the paper ejection tray 21-S-1 is [Re-print], [Inspection], [OK], [NG], or [NR].

S62: When the status of the paper ejection tray 21-S-1 is [Standby], the tray information manager 32 moves the printed sheet from the paper ejection tray 21-S to be sorted to the paper ejection tray 21-S-1 at the lower stage. The tray information manager 32 transmits the sorting request of the paper ejection tray 21-S to the movement controller 37 via the operation determining unit 34. The movement controller 37 moves the printed sheet from the paper ejection tray 21-S to the paper ejection tray 21-5-1.

The tray information manager 32 copies the status of the paper ejection tray 21-S to be sorted to the paper ejection tray 21-5-1 at the lower stage and changes the status of the paper ejection tray 21-S to [Standby].

Figure 19:
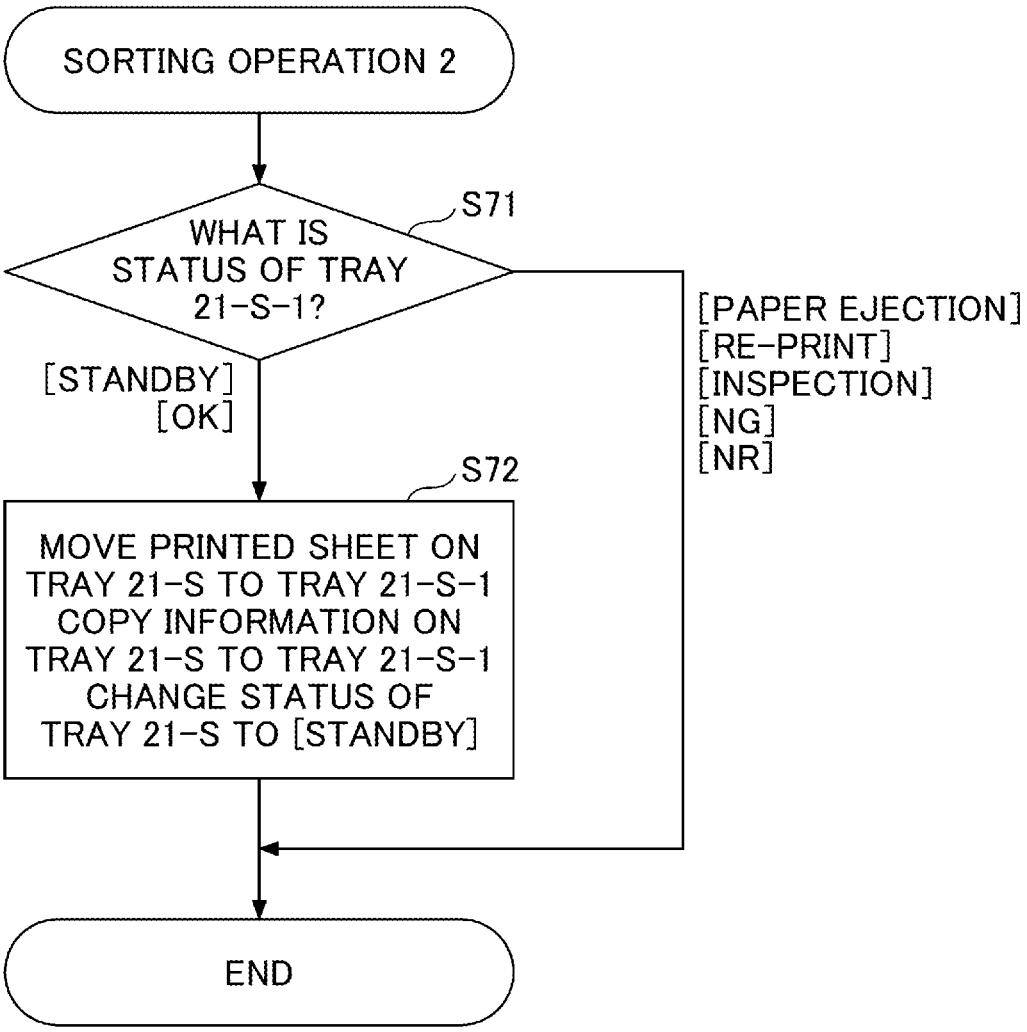
FIG. 19 is an example of a flowchart illustrating a sorting operation 2.

FIG. 19 is an example of a flowchart illustrating the sorting operation 2. The sorting operation 2 is a sorting operation when the status of the paper ejection tray 21-S (higher stage) to be sorted is [OK].

S71: The tray information manager 32 checks the status of the paper ejection tray 21-5-1 at the lower stage than the paper ejection tray 21-S to be sorted. When the status of the paper ejection tray 21-5-1 is [Paper ejection], [Re-print], [Inspection], [NG], or [NR], the tray information manager 32 terminates the sorting operation 2 without moving the printed sheet from the paper ejection tray 21-S to the paper ejection tray 21-5-1. This is to prevent mixing of the printed sheets with different statuses.

S72: When the status of the paper ejection tray 21-5-1 is [Standby] or [OK], the tray information manager 32 moves the printed sheet from the paper ejection tray 21-S to be sorted to the paper ejection tray 21-5-1 at the lower stage. The tray information manager 32 transmits the sorting request of the paper ejection tray 21-S to the movement controller 37 via the operation determining unit 34. The movement controller 37 moves the printed sheet from the paper ejection tray 21-S to the paper ejection tray 21-5-1.

The tray information manager 32 copies the status of the paper ejection tray 21-S to be sorted to the paper ejection tray 21-5-1 at the lower stage and changes the status of the paper ejection tray 21-S to [Standby].

Figure 20:
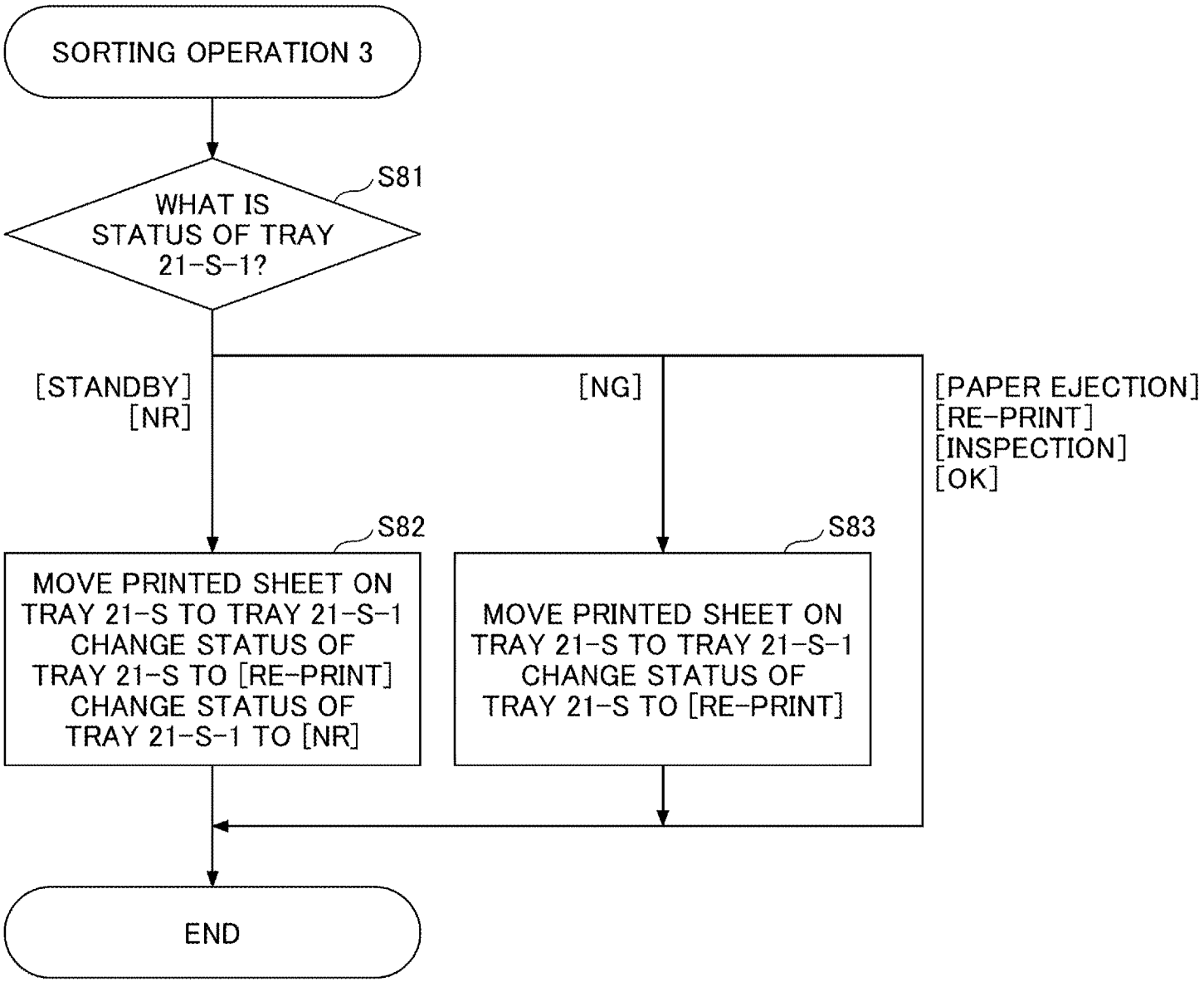
FIG. 20 is an example of a flowchart illustrating a sorting operation 3.

FIG. 20 is an example of a flowchart illustrating a sorting operation 3. The sorting operation 3 is a sorting operation when the status of the paper ejection tray 21-S (higher stage) to be sorted is [NG].

S81: The tray information manager 32 checks the status of the paper ejection tray 21-5-1 at the lower stage than the paper ejection tray 21-S to be sorted. When the status of the paper ejection tray 21-5-1 is [Paper ejection], [Re-print], [Inspection], or [OK], the tray information manager 32 terminates the sorting operation 3 without moving the printed sheet from the paper ejection tray 21-S to the paper ejection tray 21-5-1. This is to prevent mixing of the printed sheets with different statuses.

S82: When the status of the paper ejection tray 21-5-1 is [Standby] or [NR], the tray information manager 32 moves the printed sheet from the paper ejection tray 21-S to the paper ejection tray 21-5-1 at the lower stage. The tray information manager 32 transmits the sorting request of the paper ejection tray 21-S to the movement controller 37 via the operation determining unit 34. The movement controller 37 moves the printed sheet from the paper ejection tray 21-S to the paper ejection tray 21-5-1.

The tray information manager 32 changes the status of the paper ejection tray 21-S to be sorted to [Re-print] and changes the status of the paper ejection tray 21-S-1 at the lower stage to [NR] (when the status is [Standby]). Accordingly, the reprinted printed sheet is ejected to the paper ejection tray 21-S to be sorted. The printed sheet on the paper ejection tray 21-S-1 at the lower stage is not reprinted.

S83: When the status of the paper ejection tray 21-S-1 is [NG], the tray information manager 32 moves the printed sheet from the paper ejection tray 21-S to be sorted to the paper ejection tray 21-S-1 at the lower stage. The tray information manager 32 transmits the sorting request of the paper ejection tray 21-S to the movement controller 37 via the operation determining unit 34. The movement controller 37 moves the printed sheet from the paper ejection tray 21-S to the paper ejection tray 21-S-1.

The tray information manager 32 changes the status of the paper ejection tray 21-S to be sorted to [Re-print]. The status of the paper ejection tray 21-S-1 at the lower stage may remain as [NG]. Accordingly, the reprinted printed sheet is ejected to the paper ejection tray 21-S to be sorted.

Figure 21:
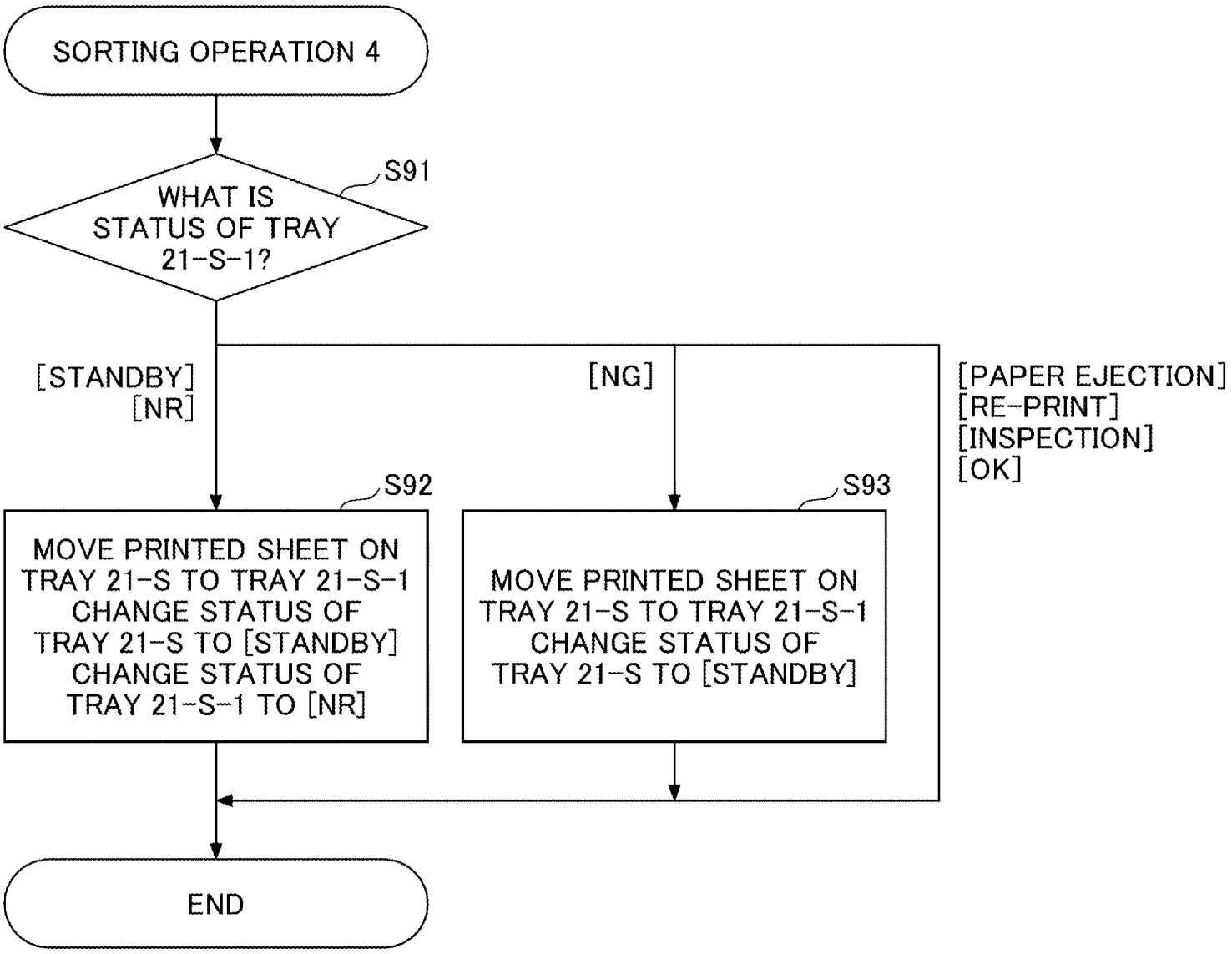
FIG. 21 is an example of a flowchart illustrating a sorting operation 4.

FIG. 21 is an example of a flowchart illustrating a sorting operation 4. The sorting operation 4 is a sorting operation when the status of the paper ejection tray 21-S (higher stage) to be sorted is [NR].

S91: The tray information manager 32 checks the status of the paper ejection tray 21-5-1 at the lower stage than the paper ejection tray 21-S to be sorted. When the status of the paper ejection tray 21-5-1 is [Paper ejection], [Re-print], [Inspection], or [OK], the tray information manager 32 terminates the sorting operation 4 without moving the printed sheet from the paper ejection tray 21-S to the paper ejection tray 21-5-1. This is to prevent mixing of printed sheets with different statuses.

S92: When the status of the paper ejection tray 21-5-1 is [Standby] or [NR], the tray information manager 32 moves the printed sheet from the paper ejection tray 21-S to the paper ejection tray 21-5-1 at the lower stage. The tray information manager 32 transmits the sorting request of the paper ejection tray 21-S to the movement controller 37 via the operation determining unit 34. The movement controller 37 moves the printed sheet from the paper ejection tray 21-S to the paper ejection tray 21-5-1.

The tray information manager 32 changes the status of the paper ejection tray 21-S to be sorted to [Standby] (because the paper ejection tray with the [NR] status is not for reprinting), and changes the status of the paper ejection tray 21-S-1 at the lower stage to [NR] (when the status is [Standby]). The printed sheet on the paper ejection tray 21-S-1 at the lower stage is not reprinted.

S93: When the status of the paper ejection tray 21-S-1 is [NG], the tray information manager 32 moves the printed sheet from the paper ejection tray 21-S to be sorted to the paper ejection tray 21-S-1 at the lower stage. The tray information manager 32 transmits the sorting request of the paper ejection tray 21-S to the movement controller 37 via the operation determining unit 34. The movement controller 37 moves the printed sheet from the paper ejection tray 21-S to the paper ejection tray 21-S-1.

The tray information manager 32 changes the status of the paper ejection tray 21-S to be sorted to [Standby]. The status of the paper ejection tray 21-S-1 at the lower stage may remain as [NG].

<Example of Sorting>

FIG. 22 is a diagram illustrating changes in the statuses of the paper ejection trays resulting from the sorting operation. In FIG. 22, (a) illustrates the status of the paper ejection tray 21-3 before sorting, and (b) illustrates the status of the paper ejection tray 21-3 after sorting. In FIG. 22, (c) illustrates the status of the paper ejection tray 21-2 before sorting, and (d) illustrates the status of the paper ejection tray 21-2 after sorting. The unit of reprinting (the unit of quality inspection) is 3 pages.

As illustrated in (a) of FIG. 22, pages 4 to 6 are ejected to the paper ejection tray 21-3 before sorting, and the inspection result on page 5 is NG. As illustrated in (c) of FIG. 22, pages 1 to 3 are ejected to the paper ejection tray 21-2 before sorting, and the inspection result on page 2 is NG. The statuses and the sub-statuses of the paper ejection trays 21-2 and 21-3 are [NG].

As illustrated in (d) of FIG. 22, pages 4 to 6 are moved from the paper ejection tray 21-3 to the paper ejection tray 21-2. The sub-statuses of pages 4 to 6 are [NR]. Further, as illustrated in (b) of FIG. 22, the status of the paper ejection tray 21-3 is [Re-print] and pages 4 to 6 are ejected again.

When pages 1 to 6 of the paper ejection tray 21-2 are moved to the paper ejection tray 21-1, only pages 1 to 3 have the [NG] sub-status. Therefore, the tray information manager 32 may allocate the [Re-print] sub-status for only pages 1 to 3. Accordingly, the reprinted pages 1 to 3 are ejected which are corresponding to the pages 1 to 3 of the paper ejection tray 21-2. In this way, by using the sub-status, the paper ejection apparatus 103 only needs to reprint the minimum number of pages.

When pages 1 to 6 are moved from the paper ejection tray 21-1 to the main tray 22, the status of the paper ejection tray 21-1 is set to [NR], so that pages 1 to 6 are shifted. Thereafter, since pages 1 to 6 of the paper ejection trays 21-2 and 21-3 are ejected to the main tray 22, the order of pages is maintained. By removing the shifted pages 1 to 6, the user can obtain the printed sheet with normal inspection result in the order of pages.

<Main Effect>

As described above, the paper ejection apparatus according to the embodiment ejects the printed sheet with the abnormal inspection result to the main tray 22 in a state in which the printed sheet with the abnormal inspection result is shifted from the printed sheet with the normal inspection result. Since the paper ejection tray is secured for reprinting, the printed sheet is ejected to the main tray 22 in the order of pages. The user can obtain the printed sheet with the normal inspection result which is ultimately sorted correctly just by extracting the printed sheet with the abnormal inspection result. Since the paper ejection apparatus 103 can perform paper ejection into the paper ejection tray above the paper ejection tray for reprinting without waiting for the inspection result, a mechanism such as a longer conveying path or a primary storage for the printed sheet with the abnormal inspection result, is unnecessary.

<Other Application>

While the preferred embodiment of the present invention has been described with reference to examples, the present invention is not limited to these examples, and various modifications and substitutions may be made thereto without departing from the gist of the present invention.

For example, a configuration example, such as FIG. 9, is divided according to main functions for easier understanding of processing by the paper ejection apparatus 103. The present invention is not limited by the method of dividing the processing unit or by the name thereof. The processing of the paper ejection apparatus 103 may be further divided into more processing units depending on the processing contents. Alternatively, one processing unit can be split to include more processing.

Also, the devices described in the examples are merely indicative of one of a plurality of computing environments for carrying out the embodiments disclosed herein. In some embodiments, the inspection device 102 includes a plurality of computing devices such as a server cluster. The plurality of computing devices are configured to communicate with each other via any type of communication link, including networks, shared memory, and the like, and perform the processes disclosed herein.

The functions of the embodiments described above may be implemented by one or more processing circuits. As used herein, a "processing circuit" includes a processor programmed to perform each function by software, such as a processor implemented in electronic circuits, and devices designed to perform each function as described above such as an Application Specific Integrated Circuit (ASIC), a Digital Signal Processor (DSP), a Field Programmable Gate Array (FPGA), and a conventional circuit module.

According to at least one embodiment, a paper ejection apparatus is provided that is capable of ejecting a printed sheet before obtaining an inspection result.

What is claimed is:

1. A paper ejection apparatus comprising:

paper ejection trays to which printed sheets are selectively ejected;

a main tray disposed lower than the paper ejection trays;

an inspection result acquirer configured to acquire an inspection result of each of the printed sheets;

a paper ejection controller configured to control paper ejection such that each of the printed sheets is ejected to the paper ejection trays before the inspection result is obtained by the inspection result acquirer; and a tray information manager configured to manage by associating identification information of each of the paper ejection trays with the inspection result of each of the printed sheets ejected on the paper ejection trays, wherein the tray information manager secures, for reprinting, one of the paper ejection trays on which a printed sheet with an abnormal inspection result is ejected, and wherein the paper ejection controller controls paper ejection such that a reprinted sheet having a page number that is same as that of the printed sheet with the abnormal inspection result is ejected to the one of the paper ejection trays that is secured.

2. The paper ejection apparatus according to claim 1, wherein the paper ejection apparatus further comprises a movement controller configured to move a printed sheet with a normal inspection result and the printed sheet with the abnormal inspection result from a lowermost paper ejection tray to the main tray in a state in which the printed sheet with the abnormal inspection result is distinguishable from the printed sheet with the normal inspection result by a user, and to repeatedly perform a first process in which a printed sheet in an S-th paper ejection tray from a bottom (S: an integer greater than or equal to 2 and having an initial value of 2) is moved to an S-1-th paper ejection tray, and a second process in which S is increased by one after each performance of the first process, and wherein the tray information manager is configured to update the correspondence between the identification information of each of the paper ejection trays and the inspection result of each of the printed sheets in response to the movement of the printed sheet by the movement controller.

3. The paper ejection apparatus according to claim 2, wherein the movement controller moves the printed sheet with the normal inspection result and the printed sheet with the abnormal inspection result from the lowermost paper ejection tray to the main tray in a state where the printed sheet with the normal inspection result and the printed sheet with the abnormal inspection result are relatively shifted with respect to each other.

4. The paper ejection apparatus according to claim 2, wherein the tray information manager manages a status of each of the paper ejection trays by setting the status of each of the paper ejection trays to any one of statuses including a paper ejection status in which a next one of the printed sheets is ejected in turn, a re-print status in which the printed sheet that is reprinted is ejected, an inspection status in which a specified number of printed sheets are ejected for which the inspection result is awaiting to be confirmed, an OK status in which all printed sheets ejected thereto are found to be normal as a result of the inspection, an NG status in which at least one of printed sheets ejected thereto is found to be abnormal as a result of the inspection, an NR status indicating one of the paper ejection trays to which a printed sheet is moved from the higher tray with the NG status, and an standby status indicating one of the paper ejection trays with no printed sheet, and wherein the tray information manager controls the movement of a printed sheet from the S-th paper ejection tray to the S-1-th paper ejection tray, according to a combination of the statuses of the S-th paper ejection tray and the S-1-th paper ejection tray.

5. The paper ejection apparatus according to claim 4, wherein when the status of the S-th paper ejection tray is the NG status, and the status of the S-1-th paper ejection tray is the NG status or the NR status, the movement controller moves the printed sheet from the S-th paper ejection tray to the S-1-th paper ejection tray, and the tray information manager changes the status of the S-th paper ejection tray to the re-print status.

6. The paper ejection apparatus according to claim 4, wherein when the status of the S-th paper ejection tray is the NR status, and the status of the S-1-th paper ejection tray is the NG status or the NR status, the movement controller moves the printed sheet from the S-th paper ejection tray to the S-1-th paper ejection tray, and the tray information manager changes the status of the S-th paper ejection tray to the standby status.

7. The paper ejection apparatus according to claim 4, wherein when the status of the S-th paper ejection tray is the OK status, and the status of the S-1-th paper ejection tray is the OK status or the standby status, the movement controller moves the printed sheet from the S-th paper ejection tray to the S-1-th paper ejection tray, and the tray information manager changes the status of the S-th paper ejection tray to the standby status.

8. The paper ejection apparatus according to claim 4, wherein when the status of the S-th paper ejection tray is the paper ejection status, the re-print status, or the inspection status, and the status of the S-1-th paper ejection tray is the standby status, the movement controller moves the printed sheet from the S-th paper ejection tray to the S-1-th paper ejection tray, and the tray information manager changes the status of the S-th paper ejection tray to the standby status.

9. The paper ejection apparatus according to claim 1, wherein the tray information manager sets a sub-status of the printed sheet based on the inspection result in a unit of a predetermined number of sheets, and when at least one of the inspection result of the printed sheet included in the unit is abnormal, the tray information manager sets the sub-status of the printed sheet included in the unit as abnormal, and performs reprinting equal to the number of printed sheets included in the unit.

10. The paper ejection apparatus according to claim 1, wherein the tray information manager performs reprinting for a predetermined number of times, and when the inspection result is still not normal after the reprinting for the predetermined number of times, the tray information manager stops a printing apparatus.

11. A paper ejection method, wherein the paper ejection method is performed by a paper ejection apparatus comprising:

paper ejection trays to which printed sheets are selectively ejected; and a main tray disposed lower than the paper ejection trays, the paper ejection method comprising:

acquiring an inspection result of each of the printed sheets, by an inspection result acquirer;

controlling paper ejection such that each of the printed sheets is ejected to the paper ejection trays before the inspection result is obtained by the inspection result acquirer, by a paper ejection controller;

managing by associating identification information of each of the paper ejection trays with the inspection result of each of the printed sheets ejected on the paper ejection trays, by a tray information manager; and securing, for reprinting, one of the paper ejection trays on which a printed sheet with an abnormal inspection result is ejected, by the tray information manager, and controlling paper ejection such that a reprinted sheet having a page number that is same as that of the printed sheet with the abnormal inspection result is ejected to the one of the paper ejection trays that is secured, by the paper ejection controller.

12. An image forming system comprising:

a printer configured to output a printed sheet;

an inspection device configured to generate an inspection result of the printed sheet; and a paper ejection apparatus comprising paper ejection trays to which printed sheets are selectively ejected, and a main tray disposed lower than the paper ejection trays, wherein the paper ejection apparatus further includes an inspection result acquirer configured to acquire an inspection result of each of the printed sheets, a paper ejection controller configured to control paper ejection such that each of the printed sheets is ejected to the paper ejection trays before the inspection result is obtained by the inspection result acquirer, and a tray information manager configured to manage by associating identification information of each of the paper ejection trays with the inspection result of each of the printed sheets ejected on the paper ejection trays, wherein the tray information manager secures, for reprinting, one of the paper ejection trays on which a printed sheet with an abnormal inspection result is ejected, and wherein the paper ejection controller controls paper ejection such that a reprinted sheet having a page number that is same as that of the printed sheet with the abnormal inspection result is ejected to the one of the paper ejection trays that is secured.

* * * * *